US010337210B2

(12) United States Patent
Widén

(10) Patent No.: US 10,337,210 B2
(45) Date of Patent: Jul. 2, 2019

(54) INTERCHANGEABLE CYLINDER LOCK CORE FOR A CYLINDER LOCK UNIT

(71) Applicant: WINLOC AG, Zug (CH)

(72) Inventor: Bo Widén, Torshälla (SE)

(73) Assignee: WINLOC AG, Zug (CH)

( * ) Notice: Subject to any disclaimer, the term of this patent is extended or adjusted under 35 U.S.C. 154(b) by 0 days.

(21) Appl. No.: 15/617,779

(22) Filed: Jun. 8, 2017

(65) Prior Publication Data

US 2018/0355637 A1 Dec. 13, 2018

(51) Int. Cl.
*E05B 9/04* (2006.01)
*E05B 63/00* (2006.01)
(Continued)

(52) U.S. Cl.
CPC ..... *E05B 63/0056* (2013.01); *E05B 9/086* (2013.01); *E05B 19/0064* (2013.01);
(Continued)

(58) Field of Classification Search
CPC ..... E05B 15/14; E05B 19/0017; E05B 19/14; E05B 19/0041; E05B 19/0035; E05B 19/0058; E05B 19/0023; E05B 19/0052; E05B 21/00; E05B 27/00; E05B 27/0003; E05B 27/0007; E05B 27/001; E05B 27/0014; E05B 27/0017; E05B 27/0021; E05B 27/0032; E05B 27/0039; E05B 27/0042; E05B 27/005; E05B 27/0053; E05B 27/0082; E05B 27/083; E05B 27/086; E05B 29/0006; E05B 29/00;
(Continued)

(56) References Cited

U.S. PATENT DOCUMENTS 1,656,854 A * 1/1928 Best ..... E05B 9/084 24/523
3,298,211 A * 1/1967 Russell ..... E05B 9/084 70/369

(Continued)

OTHER PUBLICATIONS

CX5 High Security Cylinders, Small Format, Interchangeable Core, Service Manual, www.cx5security.com.

(Continued)

*Primary Examiner* — Suzanne L Barrett
*Assistant Examiner* — Morgan J McClure
(74) *Attorney, Agent, or Firm* — Birch, Stewart, Kolasch & Birch, LLP

(57) ABSTRACT

An interchangeable cylinder lock core with a mechanism for transferring a torque to a lock unit when a key plug is rotated. The interchangeable cylinder lock core includes a shell having an upper part, provided with a central row of locking pins in associated cavities, and a lower part with a cylindrical bore accommodating the rotatable key plug. At least a part of the cylindrical bore extends through a rotatable retainer sleeve. A back region of the key plug has a minimum length with the adjoining front region of the key plug being located in front of the mechanism for transferring torque. The adjoining front region accommodates, in addition to the central row of locking pins, at least one side locking mechanism which is located in its entirety within the front region of the key plug and interacts with at least one recess in a fixed front end sleeve portion.

47 Claims, 9 Drawing Sheets

(51) Int. Cl.

| | |
|---|---|
| ***E05B 27/00*** | (2006.01) |
| ***E05B 35/08*** | (2006.01) |
| ***E05B 19/00*** | (2006.01) |
| ***E05B 9/08*** | (2006.01) |
| *E05B 29/00* | (2006.01) |

(52) U.S. Cl.
CPC ..... *E05B 27/0003* (2013.01); *E05B 27/0039* (2013.01); *E05B 27/0082* (2013.01); *E05B 35/08* (2013.01); *E05B 19/0017* (2013.01); *E05B 29/00* (2013.01); *E05B 29/0006* (2013.01)

(58) Field of Classification Search
CPC ..... E05B 29/0013; E05B 29/002; E05B 29/0026; E05B 29/0033; E05B 29/004; E05B 29/0066; E05B 19/24; E05B 19/00; E05B 19/0064; E05B 29/086; E05B 35/08; E05B 63/0056
See application file for complete search history.

(56) References Cited

U.S. PATENT DOCUMENTS 3,499,302 A * 3/1970 Flora ..... E05B 27/0039 70/378
4,075,879 A * 2/1978 Christopher ..... E05B 29/00 70/337
4,123,926 A * 11/1978 Elder ..... E05B 9/086 70/369
4,282,731 A * 8/1981 Taksony ..... E05B 27/0064 70/419
4,328,690 A * 5/1982 Oliver ..... E05B 9/086 70/369
RE31,910 E * 6/1985 Oliver ..... E05B 9/086 70/369
4,630,457 A * 12/1986 Kincaid ..... E05B 9/086 70/337
4,672,827 A * 6/1987 Craig ..... E05B 9/086 70/367
4,712,401 A * 12/1987 Monahan ..... E05B 27/005 70/382
4,715,201 A * 12/1987 Craig ..... E05B 9/086 70/367
4,761,978 A * 8/1988 Walla ..... E05B 9/086 70/367
4,998,426 A * 3/1991 Genakis ..... E05B 27/0039 70/378
5,119,654 A * 6/1992 Ceron ..... E05B 9/086 70/369
5,131,249 A * 7/1992 Baden ..... E05B 19/0029 70/398
5,176,015 A * 1/1993 Sussina ..... E05B 27/0053 70/340
5,375,444 A * 12/1994 Smith ..... E05B 27/0053 70/337
5,419,168 A * 5/1995 Field ..... E05B 27/0039 70/378
5,421,179 A 6/1995 Bergström
5,431,034 A * 7/1995 Fann ..... E05B 9/086 70/337
5,507,163 A * 4/1996 Juang ..... E05B 9/086 70/369
5,784,910 A * 7/1998 Eizen ..... E05B 19/00 70/395
5,813,260 A * 9/1998 Widen ..... E05B 9/086 70/369
5,826,451 A * 10/1998 Cook ..... E05B 29/00 70/358
6,173,595 B1 * 1/2001 Hughes ..... E05B 19/20 70/394
6,257,033 B1 * 7/2001 Ziv-Av ..... E05B 27/0021 70/409
6,301,942 B1 * 10/2001 Shvarts ..... E05B 9/084 70/367
6,477,876 B1 * 11/2002 Kim ..... E05B 27/0078 70/409
6,526,791 B2 * 3/2003 Shvarts ..... E05B 9/084 70/409
6,708,539 B1 * 3/2004 Widen ..... E05B 9/04 70/369
6,758,073 B2 * 7/2004 Yu ..... E05B 27/001 70/358
6,910,356 B2 * 6/2005 Price ..... E05B 15/1614 70/358
6,978,647 B2 * 12/2005 Edwards, Jr. ..... E05B 9/086 70/495
6,981,396 B1 * 1/2006 Kim ..... E05B 9/086 70/369
7,059,160 B2 * 6/2006 Keller ..... E05B 9/045 70/375
7,370,502 B2 * 5/2008 Widen ..... E05B 27/0082 70/409
7,634,930 B2 * 12/2009 Boesel ..... E05B 29/00 70/383
7,647,798 B1 * 1/2010 Jones ..... E05B 27/0017 70/337
7,797,973 B2 * 9/2010 Field ..... E05B 27/0032 70/337
8,156,777 B1 * 4/2012 Widen ..... E05B 27/0017 70/392
8,327,675 B2 * 12/2012 Baumann ..... E05B 27/0078 70/409
8,336,349 B2 * 12/2012 Thimmappa ..... E05B 9/086 70/367
8,707,746 B1 * 4/2014 Liu ..... E05B 27/005 70/383
8,776,557 B2 * 7/2014 Wang ..... E05B 67/36 70/14
8,794,042 B2 * 8/2014 Herdman ..... E05B 27/005 70/341
9,127,480 B2 * 9/2015 Mathachan ..... E05B 27/0078
9,416,561 B2 * 8/2016 Field ..... E05B 19/0064
9,598,880 B2 * 3/2017 Walls ..... E05B 27/0017
9,719,275 B1 * 8/2017 Tobias ..... E05B 19/0023
2002/0056301 A1 * 5/2002 Theriault ..... E05B 27/0082 70/495
2003/0136164 A1 * 7/2003 Widen ..... E05B 9/086 70/369
2003/0188558 A1 * 10/2003 Shiao ..... E05B 9/084 70/369
2009/0241620 A1 * 10/2009 Field ..... E05B 27/0035 70/360
2010/0005842 A1 * 1/2010 Herdman ..... E05B 9/086 70/368
2011/0041579 A1 * 2/2011 Chen ..... E05B 27/005 70/495
2012/0240646 A1 * 9/2012 Herrmann ..... E05B 27/0017 70/496
2013/0312467 A1 * 11/2013 Liu ..... E05B 17/2092 70/448
2015/0240525 A1 8/2015 Walls et al.
2016/0060901 A1 * 3/2016 Lundberg ..... E05B 29/0013 70/352
2017/0152678 A1 6/2017 Clifford

OTHER PUBLICATIONS

International Search Report and Written Opinion of the International Searching Authority (Forms PCT/ISA/210 and PCT/ISA/237), dated Sep. 14, 2018, for International Application No. PCT/EP2018/062713.

* cited by examiner 100
200
110a
110
110b
40
310
110a
110
100
110b
120
130
142
141

110c
160
110d
220
210
200

240
250
230
241
40
310
110

110b
110a
151
110c
110d
220
210

40
241
250
240

221c
221b
221a
221d
221e
221f
222
220
210
240
241
242
233c
233d
233e
235a - 235g

232a - 232g
231a - 231g
251e
251d
251c
260
250
260a
252
300
371a - 371c
310
42

320
41
40
361a - 361c
331g
331f
331e
331d
331c
331b
331a
351c
351b
351a

210´
220´
241´
242´
252´
250´
240´´
200´´
220´´
241´´
242´´
252´´
250´´
240´´´
200´´´
220´´´
241´´´
242´´´
252´´´
250´´´

INTERCHANGEABLE CYLINDER LOCK CORE FOR A CYLINDER LOCK UNIT

FIELD OF THE INVENTION

The present invention relates to an interchangeable cylinder lock core with a rotatable cylindrical key plug for use together with a lock unit having a housing dimensioned to receive the interchangeable cylinder lock core, of the kind specified in the preamble of the appended claim 1. Thus, in the housing of the lock unit, there is a torque transferring mechanism, in the form of a pair of prongs, adapted to transfer a torque to the lock unit when the key plug of the interchangeable cylinder lock core is rotated. More particularly, the interchangeable cylinder core comprises:

a shell having an outer contour dimensioned to fit into said housing, the shell comprising an upper part, provided with a central row of locking pins in associated cavities, and a lower part with a cylindrical bore accommodating the rotatable key plug, at least a part of the cylindrical bore extending through a rotatable retainer sleeve, the rotatable key plug also being provided with a central row of associated cavities cooperating with the central row of locking pins, the rotatable retainer sleeve being provided with holes corresponding to the cavities for the locking pins and also being provided with an engaging member, adapted to releasably retain the interchangeable cylinder lock core in the housing, and to enable removal and replacement of the interchangeable cylinder lock core in relation to the housing of the lock unit, the key plug being rotatable in the cylindrical bore and having a back region extending from a back end, and a front region, which adjoins the back region and extends up to a front end of the key plug, a keyway extending from the front end axially along the key plug and being configured to accommodate an associated key, said central row of locking pins being arranged to engage with and lock the key plug against rotation in the lower part of the shell unless a correctly cut key is inserted into said keyway, there being two longitudinal prong holes extending along the whole length of the back region of the key plug from the back end thereof so as to provide, in use together with the lock unit, an effective guiding of the prongs and a secure engagement of the two prongs in the prong holes, when the key plug is being rotated while transferring a torque onto the two prongs.

The invention also relates to a lock and key system including an interchangeable cylinder lock core of the above-defined kind, wherein the system comprises a first key for removal and replacing the interchangeable cylinder lock core in relation to the lock unit, and at least one second key for opening the cylinder lock core while retaining the cylinder lock core in the lock unit.

Moreover, the invention relates to a key for opening an interchangeable cylinder lock core of the kind specified above.

BACKGROUND OF THE INVENTION

Such lock and key systems, lock units and associated interchangeable cylinder lock cores are frequently used, especially in the US, in locking systems with a large number of lock units serving as door locks. From time to time, many of these cylinder lock cores need to be replaced quickly whenever an associated key is lost, or a new tenant, owner or user wishes to upgrade the door lock with a new cylinder lock core.

Since the 1930's the Best Lock Company has dominated the US market for this kind of locking systems. Accordingly, there exist today a huge number of such door lock units. A number of manufacturers are providing their own interchangeable cylinder lock cores to replace the existing ones.

However, in general, there are no really high security interchangeable lock cylinder cores on the market.

One reason for this is that the key plug has a relatively small diameter and that most of the space is occupied by cavities for accommodating the locking pins, a keyway as well as the two prong holes in the back region of the key plug. There is no room for a conventional side bar or other kinds of side tumbler mechanisms which normally require a longitudinal extension along the full length of the key plug.

Another reason is that the two prong holes have to be dimensioned so that even a relatively high torque can be transferred to the lock unit by way of a cam or some other locking device coupled to the lock unit, e.g. for closing a door effectively. Therefore, the cam or other locking device has to be securely fastened to each of the prongs, and the prongs have to fit well into the prong holes. They must not lose their engagement or break.

Also, in order to enable an easy mounting of the cylinder lock core into the housing of the existing lock unit, there must be a certain play between the prong holes and the prongs, so as to enable an easy and effective guiding of the prongs into the prong holes. Once, mounted, the engagement must be secure, with no risk for disengagement or breakage.

Accordingly, a good guidance and an effective engagement between the prongs and the prong holes will require that the two prong holes in the back region of the key plug are relatively long, preferably having mutually the same length, so that they will symmetrically carry the same load when a torque is applied.

A recently developed system, including an interchangeable cylinder lock core of the kind defined in the first paragraph above is disclosed in U.S. Pat. No. 8,186,194 (Field et al). In this prior art system, the lock comprises a conventional cylinder lock with a shell and a key plug having two long prong holes in a back region and an auxiliary side locking system which is separate from the normal central row of locking pins. The auxiliary side locking system comprises an auxiliary locking pin being disposed in an associated hole in a side region of the key plug and being movable between a first position, in which a portion thereof projects outside the key plug, and a second position in which the auxiliary locking pin is retracted into said hole. A slider arranged in the key plug, underneath the auxiliary locking pin, is movable axially along the key plug between a first position, where it holds the auxiliary pin in said first position, and a second position, where it permits the auxiliary pin to fall down to its second, retracted position. In this way, the key plug is released so that it may be rotated within the shell. In an alternative embodiment, the auxiliary pin engages directly with a retainer sleeve which surrounds the key plug.

The auxiliary side locking system will ensure that the key plug is effectively locked in its rotary position and cannot rotate as long as the slider is held in its first position. Even if all the regular locking pins are manipulated or "bumped" into their correct releasing positions in an attempt to pick the lock, the remaining auxiliary side locking pin will prevent rotation of the key plug. So, this prior art system will substantially increase the safety against lock picking.

In another prior art exchangeable lock construction of similar design, disclosed in the U.S. Pat. No. 6,981,396 (Kim), there is a key plug with a side locking mechanism including a sidebar which interacts with a number of side locking tumblers. The side bar also interacts with a retainer sleeve (a "tubular operation body") which extends along the full length of the key plug. Accordingly, on the side provided with the side bar, the key plug will be solid virtually all the way to its rear end, and the associated prong in the associated lock unit will have to be sheared in order to accommodate the key plug and its security full length sidebar. With this construction, the torque to be transferred to the lock unit, by rotating the key plug by means of an inserted key, will be effected by means of one prong only, situated on the opposite side of the key plug.

OBJECTS OF THE INVENTION

There is always a need for further improvement, and the main object of the present invention is to further increase the security and provide an interchangeable cylinder lock core with a high security side locking mechanism which is very difficult to manipulate so as to open the lock without using a properly cut key and which will also permit the key plug to have two long prong holes, so that the prongs may be securely engaged with both of the prong holes in the key plug, when the interchangeable cylinder lock core is inserted and retained within the lock unit.

SUMMARY OF THE INVENTION

This object is achieved by providing an interchangeable cylinder lock core with the following features:

the back region of the key plug, accommodating the two longitudinal prong holes, has a length of at least half of the length of the key plug, the adjoining front region, located in front of the longitudinal prong holes, thus having a length being no longer than half of the length of the key plug, the adjoining front region accommodates, in addition to said central row of locking pins, at least one side locking mechanism, which is located in its entirety within said front region of the key plug and is adapted to interact with at least one recess in a fixed front end sleeve portion, the fixed front end sleeve portion, forming a portion of said lower part of said shell, is located radially outside said front region of the key plug and is provided with at least one recess for receiving and engaging with at least one radially projecting part of said at least one side locking mechanism, the at least one side locking mechanism is operative independently of the central row of locking pins and is disposed on at least one lateral side of the key plug, and each side locking mechanism comprises a longitudinal row of at least two coded side locking tumblers which are movable independently of each other, there being at least three different code positions for each coded side locking tumbler and a plurality of different code combinations for the side locking tumblers in the longitudinal row in said front region of the key plug.

In contrast to some of the prior art structures discussed above, there is a direct contact between the side locking tumblers and an associated key, without the intermediary of any other moving part, such as the axially movable slider in the above-mentioned prior art system. In this way, the structure will be relatively simple and reliable. Because of the different code positions for each locking tumbler in the row, the number of possible combinations will be very large, so the security will be high.

The front region of key plug is preferably substantially solid, except for the keyway, the cavities for the locking pins and any recesses and holes for accommodating the side locking mechanism or mechanisms.

Thanks to the above-defined structure of the interchangeable cylinder lock core, with a fixed sleeve portion, forming a part of the shell accommodating the rotatable key plug and being located adjacent to the front end thereof, there will be a secure and distinct interaction between the key plug and the surrounding shell, by way of the side locking mechanism which is located in its entirety within the front region of the key plug.

Preferably, there is one relatively short (in the axial direction) side locking mechanism on each side of the keyway in the front region of the key plug. Then, it is possible to accommodate at least four (two on each side) independently movable locking tumblers being separate and independent from the conventional locking pins. However, it is also possible to arrange only one side locking mechanism arranged on one lateral side of the keyway.

The length of the front region of the key plug, where the at least one side locking mechanism is located in its entirety, is preferably rather short, e.g. 50%, about 40% or about 30% of the total length of the key plug. Nevertheless, thanks to the compact structure of the side locking mechanism, it can still provide a large number of code combinations and a high security for the interchangeable lock core.

It has turned out that each longitudinal row of side locking tumblers, on one or both lateral sides, may comprise at least two and preferably at least three (or even more) side locking tumblers.

The rotatable retainer sleeve may be arranged axially between a fixed front end sleeve portion and a rear end sleeve portion, where the fixed sleeve portions define the cylindrical bore together with the rotatable sleeve.

As an alternative, the rotatable retainer sleeve may extend from the back end of the key plug up to a fixed front end sleeve portion, or it may extend all the way up to the front end of the key plug. In the latter case, there must be through-going recesses or a longitudinal slot in this part of the retainer sleeve, so that the projecting part may reach the surrounding fixed front end sleeve portion and its recesses or slot.

As defined in the depending claims, the rotatable sleeve portion may have a thinner cylindrical wall than a fixed front end sleeve portion. It is also possible that a fixed front end sleeve portion as well as the rotatable retainer sleeve are provided with recesses at their inside cylindrical surfaces for accommodating a radially projecting part of the side locking mechanism.

Also, according to the present invention, there is provided a lock and key system including an interchangeable cylinder lock core as defined above, wherein the lock and key system comprises a first key for removal and replacement of the interchangeable cylinder lock core in relation to the lock unit, and at least one second key for opening the cylinder lock core while retaining the cylinder lock core in the lock unit, the second key comprising a grip portion and a key blade, wherein:

said key blade has an edge code pattern comprising a longitudinal continuous row of code portions defined by V-shaped bittings configured to interact with said central row of locking pins in said shell of the cylinder lock core, and said key blade also has a wave-like side code pattern configured to interact with said at least one side locking mechanism being located in the front region of the key plug on at least one lateral side of said key plug, and said wave-like side code pattern is confined substantially to the longitudinal half of the key blade located closest to said grip portion and comprises at least two coded portions configured to interact with said at least two side locking tumblers of the side locking mechanism, so as to position, upon being inserted into the key plug, the side locking tumblers in predetermined code locations that will open the lock by permitting rotation of the key plug within the lower part the shell, either directly by releasing the engagement of the side locking tumblers in relation to the fixed sleeve portion of the shell of the cylinder lock core, or via a sidebar interacting with the fixed sleeve portion of the shell of the cylinder lock core.

Further advantageous features are stated in the appended claims, and will also appear from the detailed description of some preferred embodiments, reference being made to the attached drawings.

DETAILED DESCRIPTION OF PREFERRED EMBODIMENTS

Figures 4A, 4B, 4C, 4D, 4E:
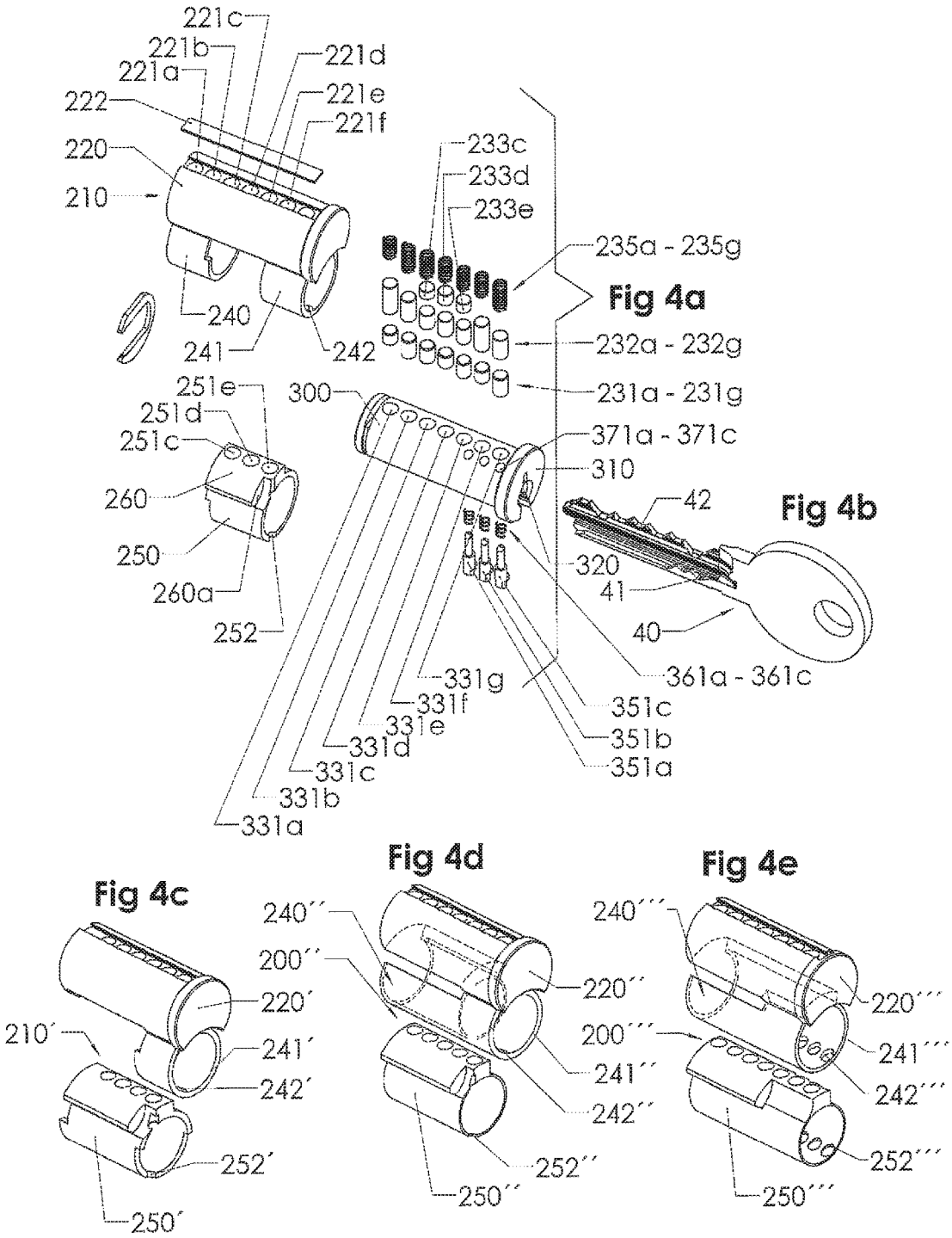
FIG. 4*a* shows an exploded view of the various parts of a lock and key system according to the invention, including an interchangeable cylinder lock core, with a shell, a number of locking pins, a rotatable key plug, a retainer sleeve, and a side locking mechanism, and a key for operating the cylinder lock core.
FIG. 4*b* shows a perspective view of the key of FIGS. 2*a* and 3*a*, in a perspective view from the other side.
FIG. 4*c* shows a modified version of the interchangeable core of FIG. 4*a*, including a longer retainer sleeve and a front end sleeve portion.
FIG. 4*d* shows a further modified version of the interchangeable core of FIG. 4*a*, with a front end sleeve portion being integrated with a rear end sleeve portion.
FIG. 4*e* shows another modified version of the interchangeable core of FIG. 4*a*, with a full length retainer sleeve and a surrounding fixed sleeve.

A first embodiment of the invention is shown in FIGS. 1, 2*a*, 2*b*, 3*a*, 3*b*, 4*a*, 4*b*, 4*f*, 5*a*, 5*b*, 5*c*, 5*d* and 5*e*, including a lock unit 100 and an interchangeable cylinder lock core 200 with a rotatable key plug 300 (FIG. 4*a*).

The lock unit 100 comprises a cylindrical housing 110 having a threaded rear end portion 110*a* and a slightly conical front end portion 110*b*. In a circular hole (not shown specifically) in a rear end wall 120, there is journaled a rotatable plate 130 provided with two parallel rods or prongs 141, 142, which extend in a direction towards the front end portion at the inside of the cylindrical housing 110, and a cam 151 (see FIG. 3*b*) at the back side of the rear end wall 120. The prongs 141, 142 are coupled to the cam 151 via the plate 130, so that a torque can be transferred from the prongs to e.g. a door lock mechanism.

The lock unit 100 is normally permanently mounted in a door or the like in order to cooperate with a door locking mechanism, as is well known per se. The front end of the lock unit 110 is provided with a front opening 110*c*, 110*d* having the general shape of the digit "8", leading in to the interior of the housing with the rear prongs 141, 142.

The interchangeable cylinder lock core 200 (see FIG. 2*a*) comprises a shell 210, also having the shape of the digit "8" and being dimensioned to fit with a slight play into the front opening 110*c*, 110*d* of the housing 110 of the lock unit 100, as will be seen in FIGS. 2*a*, 2*b* and FIGS. 3*a*, 3*b*. The shell 210 includes, in this embodiment, an upper, solid part 220 and a lower part 230 with two axially spaced hollow sleeve portions 240, 241 and a middle retainer sleeve 250 therebetween.

The upper, solid part 220 of the shell 210 has a central row of parallel cavities or holes 221*a*, 221*b*, 221*c*, 221*d*, 221*e*, 221*f* and 221*g*, the number of cavities being seven in this particular embodiment. As will be shown below, other normal embodiments are provided with six such cavities in a central row. At the upper side, a longitudinal cover plate 222 will noanally cover the holes 221*a*, etc. from above and keep a corresponding number of locking pins 231*a*, etc., 232*a*, etc. and associated springs 235*a*, etc. in place.

In the hollow sleeve portions 240, 241 and the middle retainer sleeve 250, a key plug 300 is rotatably mounted. A front end wall 310 of the key plug is visible in FIGS. 1 and 2*a*, but the whole key plug is seen best in FIGS. 4*a*, 5*a*, 5*b*, 5*c* and 5*d*. The outer diameter of the cylindrical key plug is slightly smaller than the inside diameters of the sleeve portions 240, 241 and the middle retainer sleeve 250, so that the key plug can rotate in relation to the shell 210. However, the possible rotary motion of the key plug is dependent on the positions of locking pins 231*a*, 231*b*, 231*c*, 231*d*, 231*e*, 231*f*, 231*g* shown in FIG. 4*a* and being movable in associated vertical cavities or holes 331*a*, 331*b*, 331*c*, 331*d*, 331*e*, 331*f*, 331*g* arranged in a central longitudinal row in the upper solid part 220 of the shell 210. These vertical holes 331*a*, etc. are located above a central keyway 320. The locking pins 231*a* etc. are held in place by associated top pins 232*a*, 232*b*, 232*c*, 232*d*, 232*e*, 332*f*, 232*g* (collectively denoted 232*a*-232*g* in FIG. 4*a*) and corresponding helical springs 235*a*, 235*b*, 235*c*, 235*d*, 235*e*, 235*f*, 235*g* (collectively denoted 235*a*-235*g* in FIG. 4*a*). In the three pin assemblies in the middle, there are also three short pins or wafers 233*c*, 233*d*, 233*e* which cooperate with the retainer sleeve 250. The latter is provided with three associated cavities or holes 251*c*, 251*d*, 251*e*, so that these short pins can be positioned exactly in these holes 251*c*, etc. to make it possible to rotate the retainer sleeve 250 by inserting a control key (not shown, denoted "first key" in the claims). When the retainer sleeve is rotated by turning such a control key, a holding lug 260 with a stop end surface 260*a* will lose its engagement with an inner shoulder 160 (FIG. 2*b*) at the inside of the housing 110 of the lock unit 100, so that the interchangeable cylinder lock 200 with its key plug 300 can be taken out as a unit (the interchangeable cylinder lock core 200, 300) from the lock unit 100.

In the normal operation of the cylinder lock, a correctly cut key 40 (denoted "second key" or just "key" in the claims) will operate the interchangeable cylinder lock 200 so as to rotate the key plug 300 and turn the rear cam 151 by means of the prongs 141, 142 (see also FIG. 5*e*), which are securely guided within associated prong holes 341, 342 (FIG. 5*d*) in the key plug 300. The diameter d1 of the prongs is normally about 3.2 mm, and the inner diameter d2 of the prong holes are normally about 3.4 mm, leaving a slight radial play of 0.1 mm therebetween.

In accordance with the present invention, the two prong holes should both have a minimum length L1 (see FIG. 5*d*), preferably the same length, of at least half of the length (L1+FR1) of the key plug, corresponding to about 4 times the diameter d2 of each prong hole 341, 342. Then, it has turned out that the prongs 141, 142 will be effectively guided when the interchangeable cylinder lock core is inserted into the housing of the lock unit and that, during use, the two prongs will be securely engaged in the prong holes when the key plug Is being rotated while transferring a torque for operating the lock. So, it is important that there are two prong holes having such a minimum length L1 in the back region of the key plug.

Also, the key plug is provided with an auxiliary side locking mechanism which is located on at least one lateral side of the keyway 320 and which is confined entirely within a front region FR1 located longitudinally in front of and adjoining the prong holes 341, 342 (see FIGS. 5*a*, 5*b*, 5*c*, 5*d*, 5*e*). Preferably, this front region FR1 is substantially solid, except for the keyway, the cavities for the locking pins and any recesses and holes for accommodating the side locking mechanism itself. According to the invention, the side locking mechanism should comprise at least two independently movable side locking tumblers providing a high security mechanism with at least three different code positions for each locking tumbler and a plurality of different code combinations for the side locking tumblers. In the embodiment described above, see FIGS. 4*a*, 4*f*, 4*k*, 5*a*, 5*b*, 5*c*, 5*d* and 5*e*, the side locking mechanism includes three locking tumblers 351*a*, 351*b*, 351*c* which are arranged in a row at one side of the keyway 320 of the key plug 300, in the solid front region thereof. This front region FR1 is generally defined as a region located in front of and adjoining the back region with the prong holes 341, 342. The three locking tumblers are located entirely within this front region and also radially inside the fixed front sleeve portion 241. This location of the side locking mechanism 351*a*, 351*b*, 351*c* has the advantage that it will interact mainly with the fixed front sleeve portion 241, in associated recesses or holes 242, next to the front end 310 of the key plug 300. Other embodiments are possible, as will be described below.

The three side locking tumblers 351*a*, 351*b*, 351*c* are biased by springs 361*a*, 361*b*, 361*c* (collectively denoted 361*a*-361*c* in FIG. 4*a*) in associated vertical cavities or holes 371*a*, 371*b*, 371*c* (collectively denoted 371*a*-371*c* in FIG. 4*a*) at some lateral distance from the keyway 320 so as to project into the keyway with a projecting finger (visible in FIG. 5*b*) which will cooperate with a wave-like side code pattern 41 on the key blade of the key 40. When the key 40 is inserted into the keyway 320, the locking tumblers 351*a*, etc. will move up and down in response to their contact with the side code pattern 41. The lower ends of the tumblers 351*a*, etc. will then interact with the associated recesses or holes 242 in the fixed sleeve portion 241. At the same time, the bittings of the upper edge portion 42 of the key 40 will interact with the central row of locking pins 231*a*, etc. Only when all of the locking pins 231*a*, etc. and the three side locking tumblers 351*a*, etc. are correctly positioned, totally within the circumference of the key plug 300, will it be possible to turn the operating key 40 (the "second key") so as to open the cylinder lock.

It is important that the side tumblers 351*a*, etc. are movable independently of the central locking pins 231*a*, etc. Thus, if the cylinder lock is manipulated with a so called "bumping" technique, it may be possible to position all the locking pins 231*a*, but it will be much more difficult to simultaneously manipulate the locking tumblers 351*a*, etc. into their respective coded positions. Thus, the side locking mechanism 351 will provide a high security for the cylinder lock core.

As a modification of the first embodiment described above, as shown in FIGS. 4*c* and 4*g*, the retainer sleeve 250' may extend along the inside of the lower part of the shell 210 all the way from the back end of the key plug 300 to a location at a distance from the front end thereof. In such an embodiment, the lower, fixed part of the shell 210' may be constituted by a front sleeve portion 241', which is similar to the front sleeve portion 241 in FIG. 4*a* and is provided with lower recesses or holes 242'. The fixed front sleeve portion 241' may have the same longitudinal length as the fixed front sleeve portion 241 or it may be shorter, possibly corresponding to a relatively short front region FR3 (see FIG. 9*h*) of the key plug. The rotatable retainer sleeve 250' may be relatively long, but in this embodiment, it will make room for a fixed front sleeve portion 241'. In this embodiment, there are six central pins and six associated central holes, and the wall thickness of the fixed front sleeve portion 241' is large enough to accommodate the recesses or holes 242' which interact with the side locking tumblers 351*a*, etc. of the side locking mechanism in the key plug.

Figure 4F:
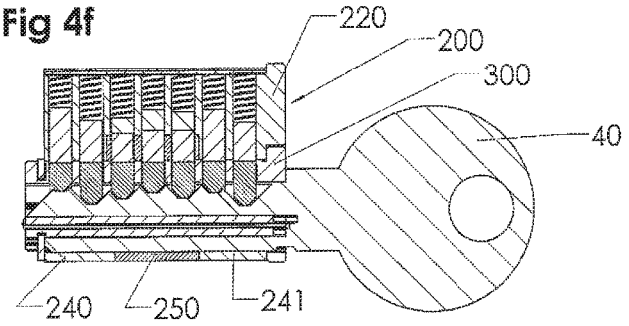
FIGS. 4*f*, 4*g*, 4*h* and 4*i* show longitudinal sections through the interchangeable cores of FIGS. 4*a*, 4*c*, 4*d* and 4*e*, respectively.
Figure 4G:
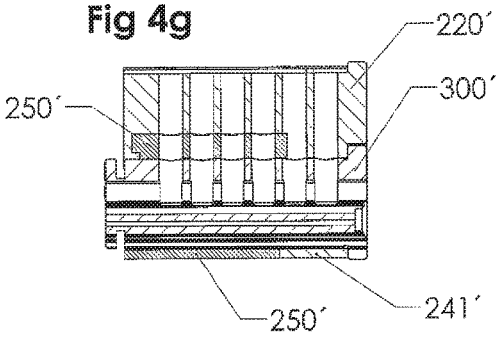
Figure 4H:
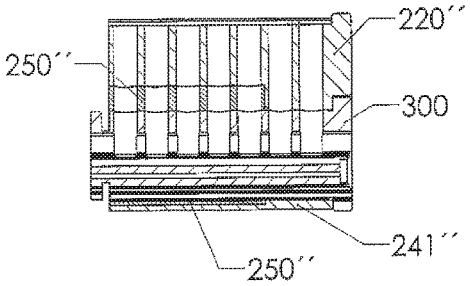

A further modification of the first embodiment shown in FIG. 4*a* is illustrated in FIG. 4*d* and FIG. 4*h*. Here, the fixed front end sleeve portion 241" has a relatively thick cylindrical wall (e.g. the same as in FIG. 4*a* and FIG. 4*c*) with recesses or holes 242" but is integrated, preferably in one piece, with a fixed rear end sleeve portion 240" having a smaller radial thickness in its cylindrical wall. The relatively long rotatable retainer sleeve 250" is mounted radially inside the fixed rear end sleeve portion 240" and also has a thin cylindrical wall, so that its interior bore has the same diameter and is aligned with the interior bore of the fixed front end sleeve portion. In this embodiment as well, the retainer sleeve can be rotated or turned in relation to the lower part of the shell with its fixed front and rear end portions. The front region of the key plug is confined longitudinally within the front end sleeve portion 241" having a relatively thick cylindrical wall.

Figure 4I:
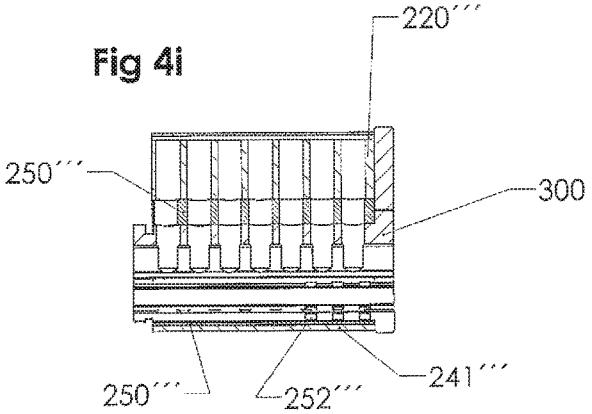

Another embodiment is shown in FIGS. 4*e* and 4*i*, where the rotatable retainer sleeve 250''' as well as the surrounding fixed sleeve 241''' both have the same length as the key plug 300, with seven central pins and associated central holes, and have rather thin cylindrical walls, the retainer sleeve 250''' being rotatable inside the fixed sleeve 241'''. Both of these sleeves are provided with lower holes or recesses 242''' and through-going holes 252''', respectively, interacting with the side locking tumblers 351*a*, etc. of the key plug.

Figure 4K:
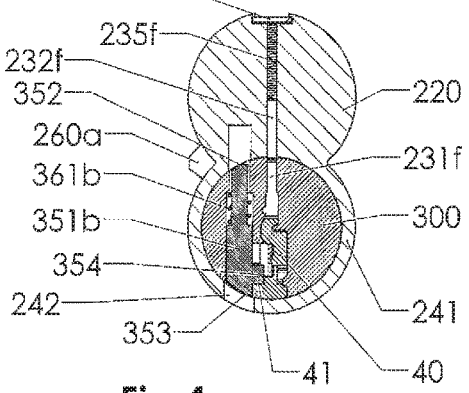
FIG. 4*k* shows a cross-section through the interchangeable core of FIG. 4*a*, at the location of a side locking tumbler.

The interaction between the side locking tumbler 351*b* of the key plug 300 and the surrounding sleeve portions is illustrated further in the FIGS. 4*k* through 4*q*, where FIG. 4*k* shows the embodiment of FIG. 4*a*, and the other FIGS. 4*l* through 4*q* show the embodiment of FIG. 4*e* and FIG. 4*i*.

In FIG. 4*k*, the side locking tumbler 351*b* is located in its totally retracted position within the key plug, where both of its ends are located at the shear line between the key plug 300 and the surrounding fixed sleeve portion 241, and the central pin 231*f* is also located with its upper end being located flush with the shear line. In this position, the key plug can be rotated or turned, provided that all other central pins and side locking tumblers are also confined within the key plug. It can also be seen that the stop end surface 260*a* of the holding lug 260 of the retaining sleeve 250 projects into its retaining, projecting position, so that the whole interchangeable cylinder lock 200, 300 is securely retained within the lock unit.

Figure 4L:
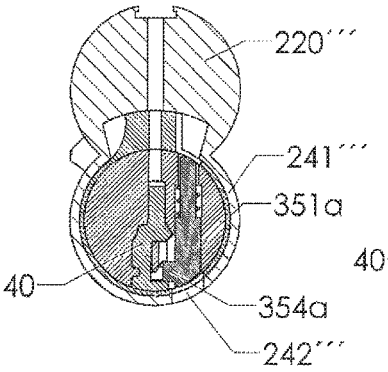
FIGS. 4*l*, 4*m* and 4*n* show cross-sections through the interchangeable core and a side locking tumbler (at the other side of the keyway) being coded in three different ways.
Figure 4M:
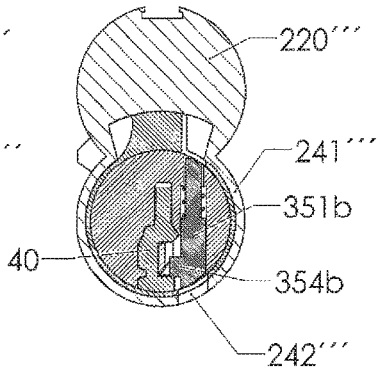
Figure 4N:
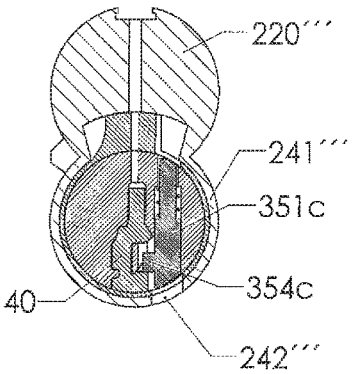
Figure 4O:
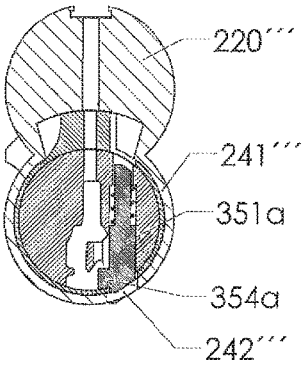
FIGS. 4*o*, 4*p* and 4*q* show the same cross-sections as in FIGS. 4*l*, 4*m* and 4*n* after withdrawal of the key from the keyway.
Figure 4P:
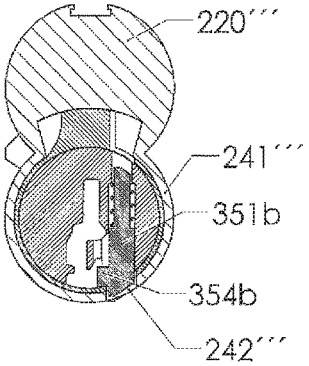
Figure 4Q:
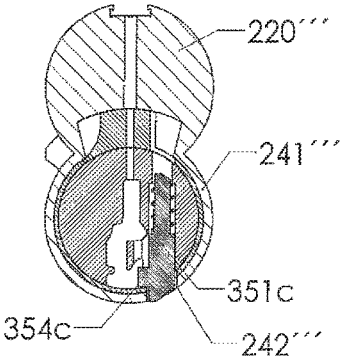

The FIGS. 4*l*, 4*m* and 4*n* show three differently coded side locking tumblers 351*a*, 351*b* and 351*c*, where the transversally projecting fingers 354*a*, 354*b* and 354*c* are located at three different heights above the lower ends of the tumblers. This will have the consequence that when the key is withdrawn from the keyway, the lower ends of the side locking tumblers 351*a*, 351*b*, 351*c* will fall down to three different levels in the holes 242''' in the fixed sleeve 241''', as illustrated in FIGS. 4*o*, 4*p* and 4*q*. Since each side locking tumbler 351*a*, 351*b*, 351*c* has three possible codes, in this example, the total number of codes for the side locking mechanism will be 3×3×3=27 in this case.

A number of embodiments of the side locking mechanism in the interchangeable cylinder lock core according to the invention will now be described.

In FIGS. 5*a*, 5*b*, 5*c*, 5*d*, 5*e*, the basic (first) embodiment of FIGS. 4*a*, 4*f* and 4*k* is shown, with three side locking tumblers 351*a*, 351*b*, 351*c* in a longitudinal row in associated holes 371*a*, 371*b*, 371*c* on one lateral side of the keyway 320, as described above.

Figure 6:
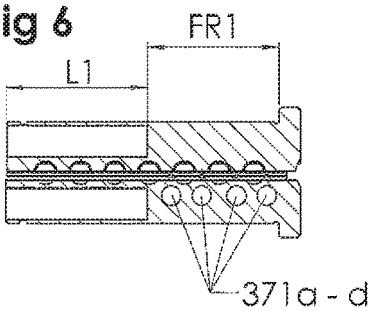
FIG. 6 shows a key plug of a similar embodiment as in FIG. 5*d*, but with four side locking tumbler holes in a row.

In a modified version of the first embodiment, as shown in FIG. 6, there are four side locking tumblers in a longitudinal row, in associated holes 371*a*, 371*b*, 371*c*, 371*d*. The back end L1 and the front end FR1 of the key plug are just as long as in the previous embodiment, and the prong holes are also exactly the same.

In a second embodiment, illustrated in FIGS. 7*a*, 7*b*, 7*c* and 7*d*, the structure is similar to the first embodiment (all the reference numerals starting with the digit 4 instead of 3), but here there is a row of side locking tumblers on each side of the keyway 420, each such row consisting of two independently movable side locking tumblers 451*a*, 451*b* and 461*a*, 461*b*, respectively. Each side locking tumbler will interact with the surrounding fixed sleeve portion (not shown) in the same way as shown in FIGS. 4*l* to 4*q*. Thus, there are four side locking tumblers which are movable independently of each other, each in at least three elevational positions. So, the number of possible code combinations will be even higher in this embodiment (at least 3×3×3×3=81).

Figure 5A:
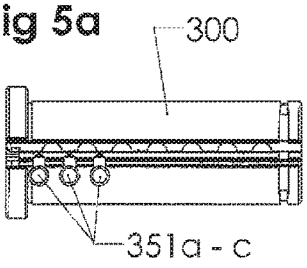
FIGS. 5*a*, 5*b*, 5*c* and 5*d* show the key plug of FIG. 4*a*, in views from below, from the front end, from above and in a longitudinal section, respectively.
Figure 5B:
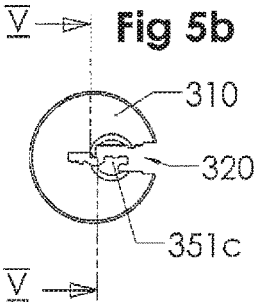
Figure 5C:
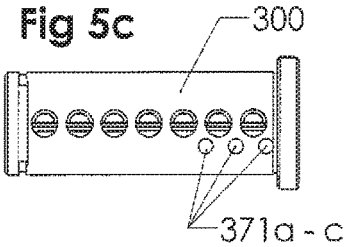
Figure 5E:
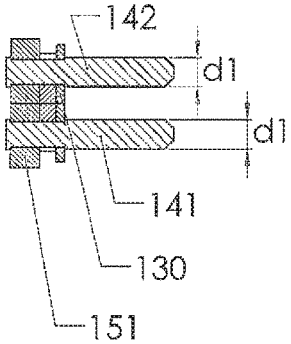
FIG. 5*e* shows the prongs of the lock unit.
Figure 5D:
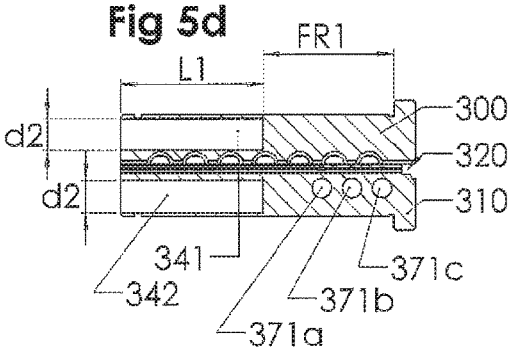

The back end L2 of the key plug 400 is somewhat longer in this second embodiment, and the front end FR2 is shorter (the total length L2+FR2 being the same as in FIG. 5*d*).

Figure 7A:
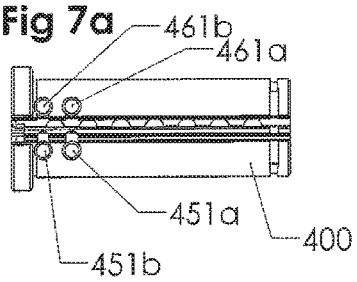
FIGS. 7*a*, 7*b*, 7*c* and 7*d* show a key plug of a second embodiment which is similar to the one of FIGS. 5*a* to 5*d*, but with a shorter side locking mechanism on each side of the key plug, with two locking tumblers in each side locking mechanism.
Figure 7B:
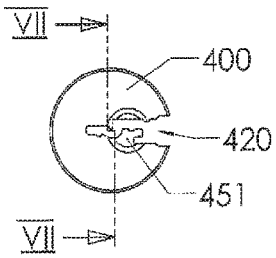
Figure 7C:
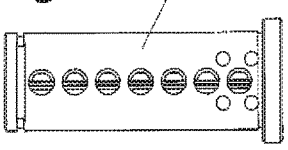
Figure 7D:
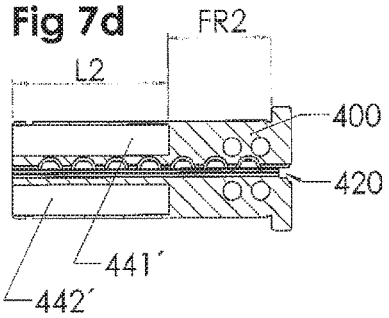
Figure 8A:
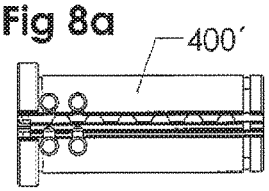
FIGS. 8*a*, 8*b*, 8*c* and 8*d* show a key plug of a modified embodiment which is similar to the one of FIGS. 5*a* to 5*d*, but with only six locking pins (instead of seven locking pins in the previous embodiments) and two side locking tumblers on each side of the key plug.
Figure 8B:
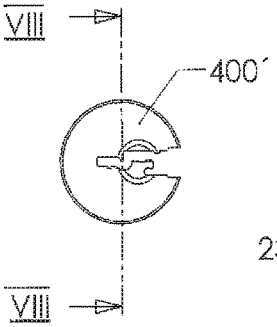
Figure 8C:
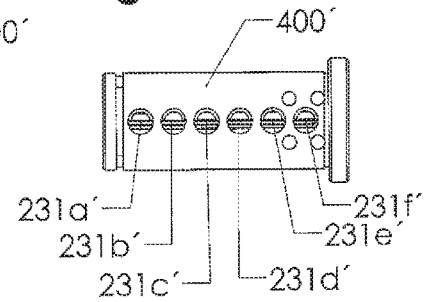
Figure 8D:
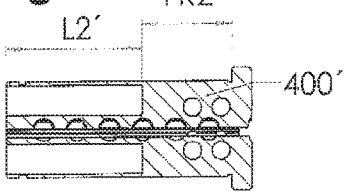

In a modified version of the second embodiment, shown in FIGS. 8*a*, 8*b*, 8*c* and 8*d*, the structure is exactly the same as in the one shown in FIG. 7*a*, etc., except that the number of central locking pins 231*a'*, . . . 231*f* (FIG. 8*c*) in the key plug 400 is six rather than seven and the total length of the key plug is a little shorter. Still, the length L2' of the prong holes is slightly more than half of the length of the key plug.

Figure 9A:
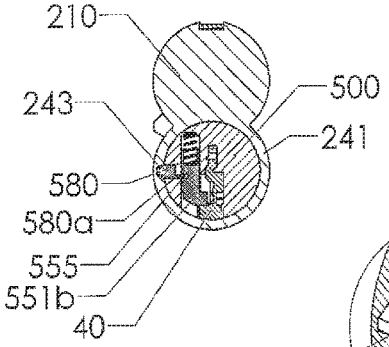
FIGS. 9*a*, 9*b*, 9*c*, 9*d*, 9*e*, 9*f*, 9*g* and 9*h* show, in various views, a third embodiment having two longer prong holes and a side locking mechanism provided with a side bar which cooperates with two side locking tumblers on one lateral side of the keyway.
Figure 9B:
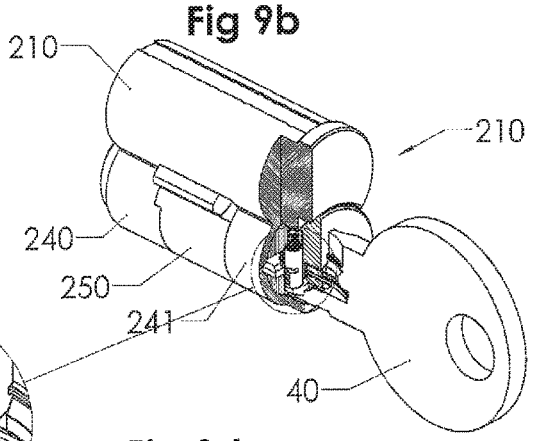
Figure 9C:
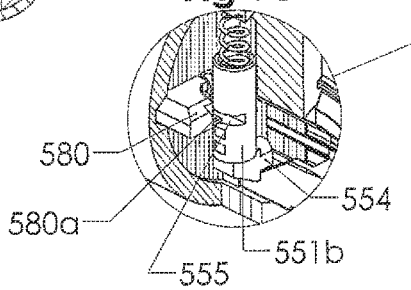
Figure 9D:
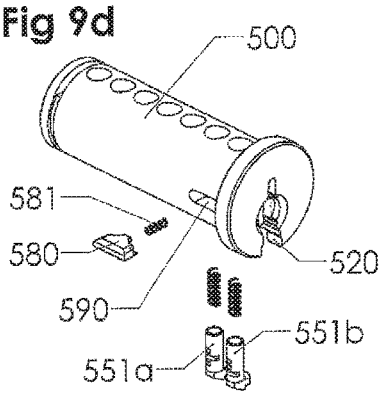
Figure 9E:
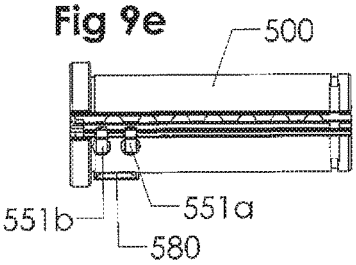
Figure 9F:
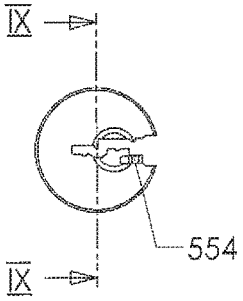
Figure 9G:
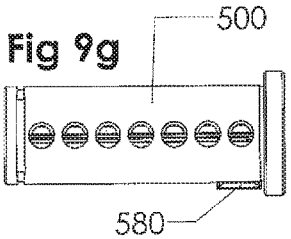
Figure 9H:
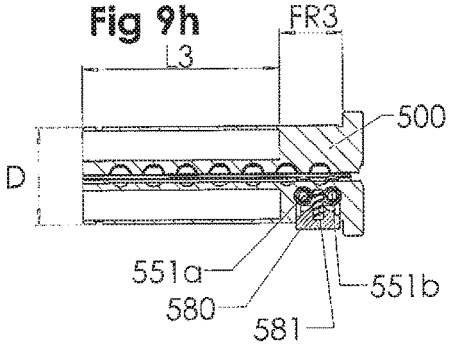

In a third embodiment, shown in FIGS. 9, 9*a*, 9*b*, 9*c*, 9*d*, 9*e*, 9*f*, 9*g*, 9*h* and FIG. 10, the number of central locking pins is again seven, like in most of the previous embodiments, but the side locking mechanism is different, with only two side locking tumblers, on one side of the key plug 500 only, these two side locking tumblers 551*a*, 551*b* cooperating with a relatively short side bar 580 (FIG. 9*d*). Such a side locking mechanism with a side bar is known per se, but not in the context of interchangeable cylinder lock cores having two relatively long prong holes. The side bar 580 is normally held in a longitudinal recess or groove 243 (see FIG. 9*a*) by a spring 581 (see FIG. 9*d*), located between the two side locking tumblers to save longitudinal space, in a position where it projects sideways outside the contour of the key plug 500. In this position, the side bar will register with the corresponding groove 243 in the front end sleeve portion 241 of the shell 200 and thereby effectively lock the key plug against rotation. However, when the side locking tumblers 551*a* and 551*b* are positioned in certain vertical positions, by means of the properly cut key 40, the side bar 580 can be moved sideways, against the action of the spring 581, into a retracted position where it is no longer seated in the groove 243. Thus, by turning the key 40, the side bar 580 will be retracted and permit rotation of the key plug 500. Then, a projecting lug 580*a* will find its way into a coded recess 555 in the cylindrical surface of the side locking tumbler 551*b*. This interaction will be seen clearly in the enlarged view in FIG. 9*c*, which also shows how the transverse finger 554 of the side locking tumbler 551*b* will be lifted to the right position by the side code pattern on the key 40. By way of the side bar, the side locking mechanism will provide a high degree of security, since it is difficult to manipulate the side locking tumblers 551*a*, 551*b* so as to release the lock. In this embodiment, with only two side locking tumblers in a row, the back region of the key plug 500 may have a greater length L3, as shown in FIG. 9*h*, leaving only a relatively short front region FR3.

Figure 10:
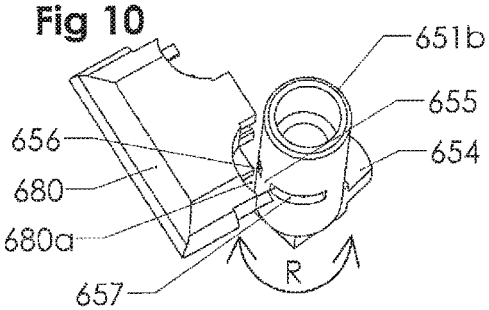
FIG. 10 shows a modified embodiment of the side locking mechanism having a side bar interacting with side locking tumblers which are movable up and down and also rotatable around their own axes.
Figure 11:
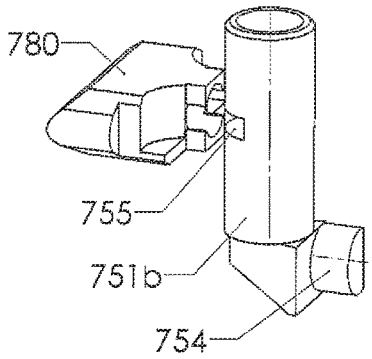
FIG. 11 shows another modified embodiment where the side locking tumblers are each provided with a longitudinally displaced finger.
Figure 12A:
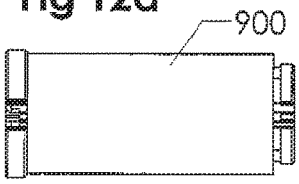
FIGS. 12*a*, 12*b*, 12*c* and 12*d* show, in views corresponding to FIGS. 5*a*, 5*b*, 5*c* and 5*d*, respectively, an embodiment having three side locking tumblers interacting with a sidebar, on one lateral side of the keyway.
Figure 12B:
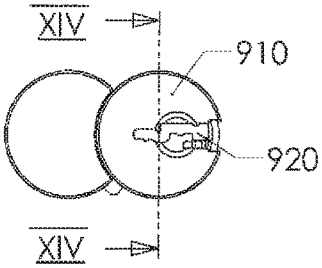
Figure 12C:
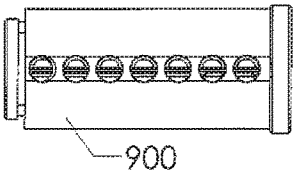
Figure 12D:
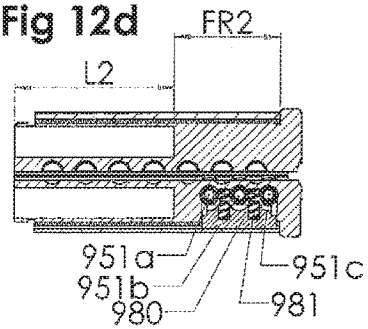
Figure 13A:
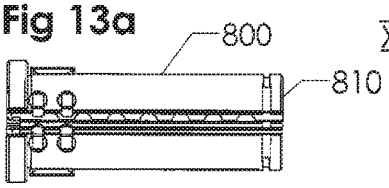
FIGS. 13*a*, 13*b*, 13*c* and 13*d* show, in views also corresponding to FIGS. 5*a* to 5*d*, a fourth embodiment with two side bars, one on each lateral side of the keyway of the key plug.
Figure 13B:
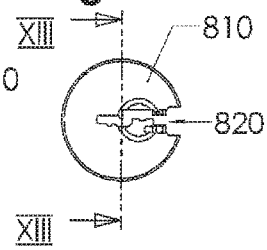
Figure 13C:
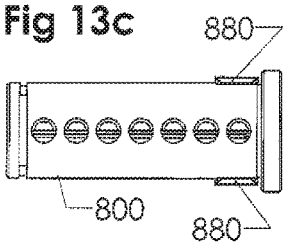
Figure 13D:
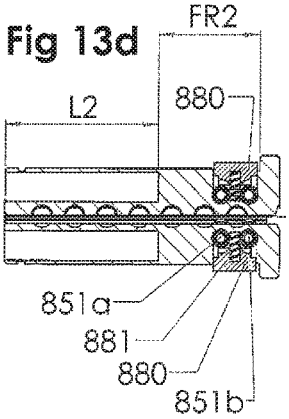

As shown in FIGS. 10 and 11, each side locking tumbler can interact in different ways with the side bar, either by way of rotating along its axis or being non-rotatable and having a longitudinally displaced finger. In FIG. 10, the side locking tumbler 651*b* can rotate between two rotary end positions, as indicated by the arrow R. A material portion 655, between two adjacent recesses 656, 657 in the cylindrical surface of the side locking tumbler can fit into a corresponding slot 680*a* in the side bar 680. With two or three rotary positions and three or more levels of the coded recesses 656, 657, the code combinations for each locking tumbler 651*b* will be 6 or higher. In this case, the code pattern at the side of the key must be configured to accommodate for two or three different pivotal positions of the transverse finger 654.

Similarly, in FIG. 11, the transverse finger 754 of the side locking tumbler 751*b*, is longitudinally displaced (along the longitudinal axis of the keyway of the key plug) into one of three coded positions. Accordingly, with several possible levels of the recesses 755 at the cylindrical surface of the tumbler, there will also be a large number of code combinations for each side locking tumbler, e.g. 9 or higher.

In a modified version of the third embodiment, shown in FIGS. 12*a*, 12*b*, 12*c*, 12*d*, there are three side locking tumblers 951*a*, 951*b*, 951*c* (on one side of the keyway 920 of the key plug 900) which interact with a somewhat longer side-bar 980, biased by springs 981.

In a fourth embodiment, shown in FIGS. 13*a*, 13*b*, 13*c* and 13*d*, there are two relatively short side locking mechanisms 880, one on each side of the keyway 820, adjacent to the front end 810 of the key plug 800. This is a favorable embodiment with a very high number of code combinations and yet a compact structure confined within a rather small part (less than 20%) of the total length of the key plug 800. The back region has a relatively long length L2 and the front region is relatively short, with length FR2, but if necessary, the front region of the key plug may be just as short as in the embodiment shown in FIG. 9*h* (FR3).

Figure 14A:
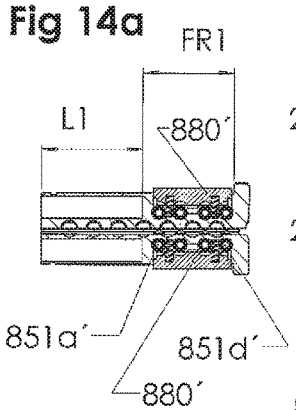
FIGS. 14*a*, 14*b*, and 14*c* show, in views corresponding to FIGS. 5*d*, 4*d* and 4*a*, respectively, some further embodiments with a longer side bar on each lateral side of the keyway, each cooperating with four side locking tumblers in a row.
Figure 14B:
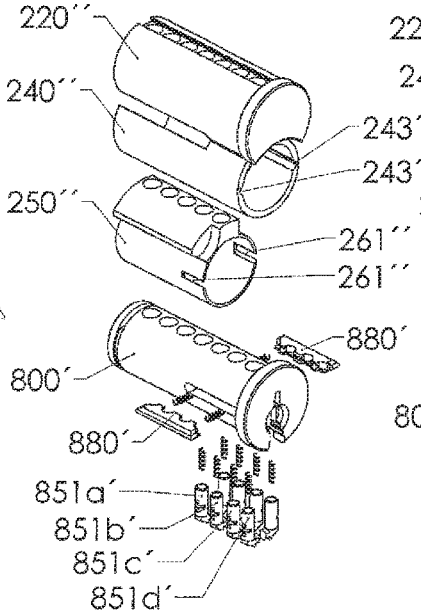
Figure 14C:
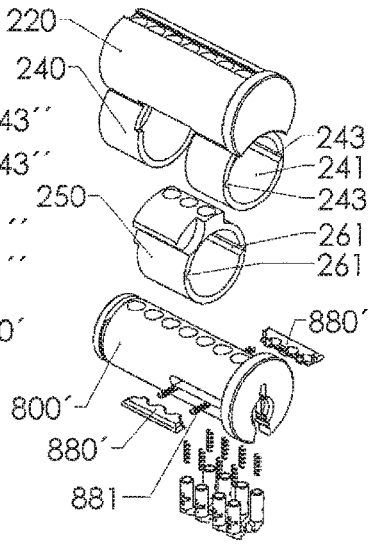

Finally, a fifth embodiment is shown in FIGS. 14*a*, 14*b* and 14*c* where the key plug 800', in its solid front end region FR1, is provided, on each side of the keyway, with a row of four side locking tumblers 851*a*', 851*b*', 851*c*', 851*d*' cooperating with an associated side bar 880'. Here, since the side locking mechanisms are arranged on both lateral sides of the keyway, each with four side locking tumblers in a row, the result will be a very large number of code combinations.

FIGS. 14*b* and 14*c* show the two possible shell structures for the fifth embodiment. In FIG. 14*b*, the shell structure is similar to the one shown in FIG. 4*d*, with an extra slot 261" on both sides of the retainer sleeve 250" for accommodating a rear end portion of the side bar 880' when the latter is located in its locking position where it is seated in the respective groove 243" in the lower fixed sleeve 240". In FIG. 14*c*, the structure is similar to FIG. 4*a*, with a rotatable retainer sleeve 250 situated between fixed rear and front end sleeve portions 240, 241. Here, there are also grooves 243 and 261 interacting with the side-bars 880'.

The side-bars shown in FIGS. 9*a* to 9*h*, 10, 11, 12*d*, 13*d* and 14*a* to 14*c* are very favorable in that the springs (e.g. 581 in FIG. 9*d*), which push the side-bar radially outwardly, are each located between a pair of side locking tumblers, so that the end of the side-bar can be positioned very close to the front end of the key plug, thereby saving space.

Also, in all embodiments, the hole (e.g. 371*c*) for the side locking tumbler (e.g. 351*c*) being located closest to the front end of the key plug is located closer to the front end than all the central holes (e.g. 331*a*-331*g*), whereby the space for the side locking mechanism is utilized efficiently, and there is consequently room for at least two and possibly three or four side locking tumblers in a row in the front region FR1, FR2, FR3 which is at the most half of the total length of the key plug.

The associated key 40, having a wave-like side code pattern 41 (see FIG. 4*b*) with code portions interacting with the side locking tumblers, will have the entire side code pattern 41 located substantially within the half of the key blade being located closest to the grip portion of the key. Furthermore, the side code portion of this pattern 41 located closest to the grip portion will be located closer to the grip portion than all the V-shaped bittings 42 on the edge of the key, the latter bittings interacting with the central row of locking pins of the cylinder lock. In this way, these keys 40 will be distinguished from all prior art keys.

As illustrated in FIGS. 1-14*c*, an interchangeable cylinder lock core (200) is provided with a rotatable cylindrical key plug (300; 300; 400'; 500; 800; 800'; 900) for use together with a lock unit (100) having a housing (110) dimensioned to receive the interchangeable cylinder lock core. A torque transferring mechanism is provided in the housing adapted to transfer a torque to the lock unit when the key plug is rotated. The torque transferring mechanism may include two longitudinal prong holes (341, 342; 441', 442') that extend from the back end of the key plug (300) for receiving two longitudinal prongs (141, 142). In the alternative, the torque transferring mechanism may be a projection extending from the rotatable plate 130 that is received in an aperture in the back end of the key plug (300) to transfer the torque of the lock unit when the key plug is rotated.

A shell (210) is provided having an outer contour dimensioned to fit into the housing (110). The shell includes an upper part (220, 220', 220"; 220'"), provided with a central row of locking pins (231*a*, . . . , 231*g*) in associated cavities (221*a*, . . . , 221*g*), and a lower part (230) with a cylindrical bore accommodating the rotatable key plug, at least a part of the cylindrical bore extending through a rotatable retainer sleeve (250). The rotatable key plug is also provided with a central row of associated cavities (331*a*, . . . , 331*g*) cooperating with the locking pins. In addition, the rotatable retainer sleeve is provided with holes (251*c*, 251*d*, 251*e*) corresponding to the cavities (331*a*, 331*b*, 331*c*) for the locking pins and also is provided with an engaging member (260), adapted to releasably retain the interchangeable cylinder lock core in the housing, and to enable removal and replacement of the interchangeable cylinder lock core in relation to the housing (110) of the lock unit.

The key plug (300; . . . ; 900) is rotatable in the cylindrical bore and includes a back region (L1; L2; L3) extending from a back end, and a front region (FR1; FR2, FR3), which adjoins the back region and extends up to a front end (310) of the key plug. A keyway (320, 420, 520) extends from the front end axially along the key plug and is configured to accommodate an associated key (40).

The central row of locking pins (231*a*, . . . , 231*g*) is arranged to engage with and lock the key plug (300; . . . ; 900) against rotation in the lower part of the shell (200, 200') unless the associated key (40) is inserted into the keyway.

The adjoining front region (FR) of the key plug accommodates, in addition to the central row of locking pins, at least one side locking mechanism (351*c*, 351*b*, 351*a*; 451*a*, 451*b*, 461*a*, 461*b*; 551*a*, 551*b*, 580, 851*a*'-851*d*', 880'; 951*a*, 951*b*, 951*c*, 980) on at least one lateral side thereof so as to engage with an inner circumferential surface of a fixed front end sleeve portion (241; 241'; 241"; 241"), which forms a portion of the lower part (230) of the shell. The at least one side locking mechanism (351*c*, 351*b*, 351*a*) is operative independently of the central row of locking pins (231*a*, 231*b*, 231*c*). In addition, the at least one side locking mechanism includes a longitudinal row of at least two coded side locking tumblers (351*a*, 351*b*, 351*c*) which are each movable independently of each other, there being at least three different code positions for each coded side locking tumbler and a plurality of different code combinations for the at least two side locking tumblers in the longitudinal row.

As illustrated in FIGS. 4*a*, 5*a*, 5*c*, 5*d*, 6, 7*a*, 7*c*, 8*a*, 8*c*, 8*d*, 9*e*, 9*h*, 12*d*, 13*a*, 13*c* and 14*a*, at least one of the coded side locking tumblers (351*c*, 371*c*, 371*d*, 451*b*, 461*b*, 551*b*, 951*c*, 851*b*, 851*d*') is located in front of the first one (331*g*, 231*f*') of the associated cavities (331*a*, . . . , 331*g*; 231*a*' . . . , 231*f*) disposed adjacent to the front end (310) of the key plug.

Figures 1, 2A, 2B, 3A, 3B:
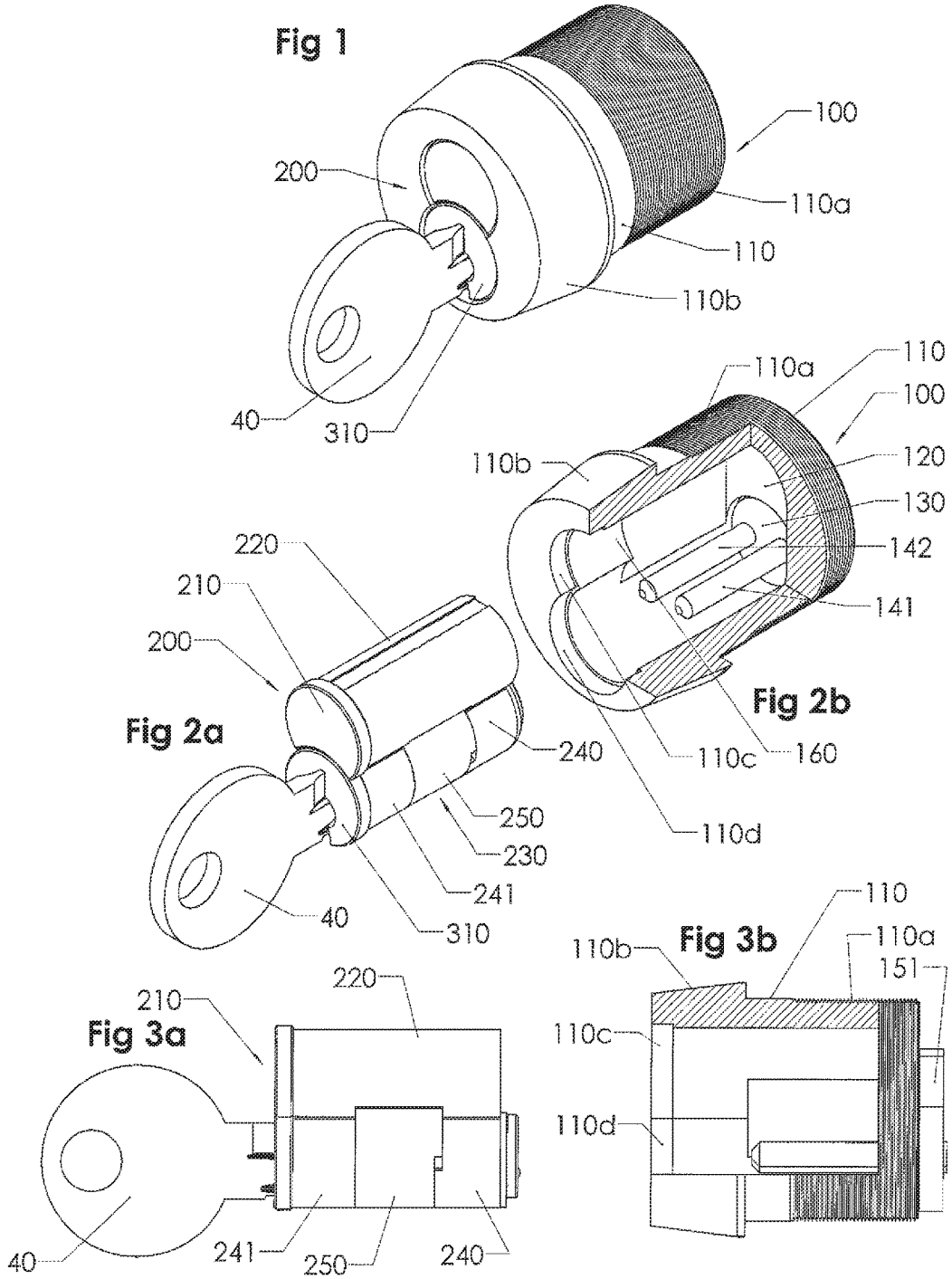
FIG. 1 shows, in a perspective view, a lock unit and an inserted interchangeable cylinder lock core according to the present invention, including a key which is inserted into a key plug forming part of the interchangeable cylinder lock core.
FIGS. 2*a* and 2*b* show, in a perspective, exploded view, the interchangeable core with the key and the lock unit (with a part thereof cut away), respectively.
FIG. 3*a* shows a side view of the interchangeable cylinder lock core of FIG. 2*a;*
FIG. 3*b* shows a side view of the lock unit of FIG. 2*b*, being partially cut away to show the inside thereof.

As illustrated in FIG. 2*a*, the rotatable retainer sleeve (250) is arranged between the fixed front end sleeve portion (241) and a rear end sleeve portion (240), the sleeve portions defining the cylindrical bore together with the rotatable retainer sleeve. As illustrated in FIGS. 4*c*-4*e*, the rotatable retainer sleeve (250'; 250"; 250'") extends from the back end of the key plug (300) up to the fixed front end sleeve portion (241, 241', 241", 241'"). The rotatable retainer sleeve (250"; 250'") has a thinner cylindrical wall than the fixed front end sleeve portion (241"; 241'") and the fixed front end sleeve portion (241") is integrated with a rear end sleeve portion (240"; 240'") having a thinner cylindrical wall than the front end sleeve portion (241"; 241'"), the rear end sleeve portion (240'; 240'") being located radially outside the rotatable retainer sleeve (250"; 250'") such that the retainer sleeve (250"; 250'") and the front end sleeve portion (241"; 241'") define the cylindrical bore.

As illustrated in FIG. 2*b*, the rotatable retainer sleeve (250) has a holding lug adapted to engage, upon insertion of the interchangeable cylinder lock core into the lock unit (100), with a recess having a shoulder (160) at the inside of the housing (110) of the lock unit (100), the holding lug on the rotatable retainer sleeve having a stop end surface being located longitudinally at the front end of the rotatable retainer sleeve.

As illustrated in FIGS. 14*a*-14*c*, the fixed front end sleeve portion (241) as well as the rotatable retainer sleeve portion (250) are provided with recesses (242, 252, 243, 243") at their inside cylindrical surfaces for accommodating radially projecting parts (351*a*, 351*b*, 351*c*, 880') of the at least one side locking mechanism.

As illustrated in FIGS. 7*a*, 7*c*, 7*d*, 8*a*, 8*c*, 8*d*, 13*a*, 13*d*, 14*a*-14*c*) the at least one side locking mechanism (451*a*, 451*b*, 461*a*, 461*b*; 851*a*, 851*b*, 880; 851*a*'-851*d*', 880') is provided on each side of the keyway (420; 820) wherein at least one of the locking tumblers (351*c*, 851*b*) is located in front of the first cavity (331*g*) of the key plug (400; 800).

As illustrated in FIGS. 4*m*, 4*p* and 9*c*, each of the coded side locking tumblers (351*b*, 551*b*) in the front region of the key plug (300, 500) is provided with a transverse finger (354*b*, 554) being held in direct contact with a side code pattern (41) on the associated key (40).

At least two each of the coded side locking tumblers (351*b*, 351*c*) are movable between a coded releasing position where they are totally confined within the key plug (300), and at least one locking position where they project radially outside the key plug and engage with the inside of the fixed front end sleeve portion (241), whereby it will prevent rotation of the key plug (300).

As illustrated in FIGS. 9*d*, 9*e*, 9*h*, 12*d* and 13*d*, the coded side locking tumblers (551*a*, 551*b*; 851*a*, 851*b*; 951*a*, 951*b*, 951*c*) in each side locking mechanism cooperate with an associated side bar (580; 880; 880'; 980) located at the cylindrical outer circumference of the key plug (500; 800; 900) and are adapted to engage with an associated groove (243) at the inside of the fixed front end sleeve portion (241), so as to prevent rotation of the key plug unless a correctly cut key is inserted into the keyway. The side bar is then seated inside the circumferential contour of the key plug.

As illustrated in FIGS. 9*c*, 10 and 11, each of the coded side locking tumblers (551*b*; 651*b*; 751*b*) is provided with a transverse finger (554; 654; 754) cooperating with a side code pattern on an associated key, and with at least one recess (555, 657, 755) in an outside portion thereof at a distance from the transverse finger, adapted to cooperate with the side bar (580; 680; 780), so as to enable the latter to disengage from the groove (243) at the inside of the front end sleeve portion (241). As illustrated in FIG. 11, the transverse finger (754) is longitudinally displaced, along the keyway, to form a coded location, in relation to a central axis of the associated coded side locking tumbler (751*b*), with each locking tumbler being coded both in respect of the longitudinal displacement of the transverse finger with the location of the at least one recess (755) cooperating with the side bar (780).

As illustrated in FIG. 10, each of the coded side locking tumblers (651*b*) is movable up and down or elevationally as well as rotationally in an associated cavity, the rotational position also forming a code.

As illustrated in FIGS. 13*d* and 14*a*-14*c*, the key plug is provided with two side locking mechanisms each having a side bar (880; 880'), one on each side of the keyway.

As illustrated in FIG. 4*a*, the at least one coded side locking mechanism may extend backwards from the area adjacent to the first cavity (331*g*).

As illustrated in FIG. 14*b*, the at least one side locking mechanism interacts also with the rotatable retainer sleeve (250") which is provided with a longitudinally extending recess (261") for accommodating a radially projecting part (880') of the at least one side locking mechanism.

As illustrated in FIGS. 1, 2*b*, 4*a*, 4*c* and 4*d*, the row of locking pins (231*a*-231*g*) in the upper part (220) of the shell comprises six or seven locking pins adapted to cooperate with bittings on an edge portion (42) of the associated key (40) being inserted into the keyway (320). The rotatable retainer sleeve (250; 250'; 250") has a holding lug (260) adapted to engage, upon insertion of the interchangeable cylinder lock core into the lock unit (100), with a recess having a shoulder (160) at the inside of the housing (110) of the lock unit (100). The holding lug (260) on the rotatable retainer sleeve includes a stop end surface (260*a*) being located longitudinally at the front end of the rotatable retainer sleeve.

As illustrated in FIGS. 9*a*-9*h*, 12*a*-12*d*, 13*a*-13*d* and 14*a*-14*c*, an interchangeable cylinder lock core with a rotatable cylindrical key plug (500; 800; 800'; 900) is provided for use together with a lock unit having a housing dimensioned to receive the interchangeable cylinder lock core, and includes a torque transferring mechanism in the housing adapted to transfer a torque to the lock unit when the key plug is rotated.

As illustrated in FIGS. 9*a* and 9*b*, the interchangeable cylinder lock core includes a shell (210) having an outer contour dimensioned to fit into the housing. As illustrated in FIGS. 4*f*-4*i*, the shell includes an upper part (220; 220"; 220'") is provided with a central row of locking pins in associated cavities and a lower part with a cylindrical bore accommodating the rotatable key plug. At least a part of the cylindrical bore extends through a rotatable retainer sleeve (250, 250"). The rotatable key plug is also provided with a central row of associated cavities cooperating with the locking pins.

The rotatable retainer sleeve is provided with holes corresponding to the cavities for the locking pins and is also provided with an engaging member, adapted to releasably retain the interchangeable cylinder lock core in the housing, and to enable removal and replacement of the interchangeable cylinder lock core in relation to the housing of the lock unit. The key plug (500; . . . ; 900) is rotatable in the cylindrical bore and having a back region (L2; L3) extending from a back end, and a front region (FR2, FR3), which adjoins the back region and extends up to a front end of the key plug. A keyway (520) extends from the front end axially along the key plug and is configured to accommodate an associated key (40).

The central row of locking pins is arranged to engage with and lock the key plug against rotation in the lower part of the shell unless the associated key (40) is inserted into the keyway. The adjoining front region (FR2, FR3) of the key plug accommodates, in addition to the central row of locking pins, at least one side locking mechanism (551*a*, 551*b*; 580; 851*a*'-851*d*'; 880'; 951*a*, 951*b*, 951*c*; 980) on at least one lateral side thereof so as to engage with an inner circumferential surface of a fixed front end sleeve portion (241), which forms a portion of the lower part of the shell. The at least one side locking mechanism is operative independently of the central row of locking pins.

As illustrated in FIGS. 9*d*, 9*e* and 9*h*, the at least one side locking mechanism includes a longitudinal row of at least two coded side locking tumblers (551*a*, 551*b*) which are each movable independently of each other, there being at least three different code positions for each coded side locking tumbler and a plurality of different code combinations for the at least two side locking tumblers in the longitudinal row.

The longitudinal row of at least two coded side locking tumblers cooperate with an associated side bar (580, 880, 880', 980), forming a part of the side locking mechanism and are adapted to engage with an associated groove (243; 243") at the inside of the fixed front end sleeve portion (241). As illustrated in FIG. 9*d*, a spring (581) is disposed between the at least one pair of the locking tumblers cooperating with the side bar. At least a pair of side locking tumblers is located adjacent to the front end of the key plug.

The rotatable retainer sleeve (250) is arranged between the fixed front end sleeve portion (241) and a rear end sleeve portion (240), the sleeve portions defining the cylindrical bore together with the rotatable retainer sleeve. The rotatable retainer sleeve (250") extends from the back end of the key plug (800') up to the fixed front end sleeve portion.

As illustrated in FIGS. 4*d*, 14*b* and 14*c*, the rotatable retainer sleeve (250") has a thinner cylindrical wall than the fixed front end sleeve portion and the fixed front end sleeve portion is integrated with a rear end sleeve portion (240") having a thinner cylindrical wall than the front end sleeve portion, the rear end sleeve portion (240") being located radially outside the rotatable retainer sleeve (250") such that the retainer sleeve (250") and the front end sleeve portion define the cylindrical bore. The fixed front end sleeve portion as well as the rotatable retainer sleeve portion (250") are provided with recesses (243"; 261") at the inside cylindrical surfaces for accommodating the side bar (880') of the at least one side locking mechanism.

As illustrated in FIGS. 4*k* and 9*c*, each of the coded side locking tumblers (351*b*, 551*b*) in the front region of the key plug (300, 500) is provided with a transverse finger (354, 554) that is held in direct contact with a side code pattern (41) on the associated key (40).

Each of the coded side locking tumblers (551*b*; 651*b*; 751*b*) is provided with a transverse finger (554; 654; 754) cooperating with a side code pattern on an associated key, and with at least one recess (555, 657, 755) in an outside portion thereof at a distance from the transverse finger that is adapted to cooperate with the side bar (580; 680; 780), so as to enable the latter to disengage from the groove (243; 243") at the inside of the front end sleeve portion (241; 240").

As illustrated in FIG. 11, the transverse finger (754) is longitudinally displaced, along the keyway, to form a coded location, in relation to a central axis of the associated coded side locking tumbler (751*b*), each locking tumbler being coded both in respect of the longitudinal displacement of the transverse finger, and the location of the at least one recess (755) cooperating with the side bar (780).

As illustrated in FIG. 10, each of the coded side locking tumblers (651*b*) is movable up and down or elevationally as well as rotationally in an associated cavity, the rotational position also forming a code.

As illustrated in FIGS. 13*d* and 14*a*-14*c*, the key plug may be provided with two side locking mechanisms each having a side bar (880; 880'), one on each side of the keyway.

In addition, the at least one coded side locking mechanism may extend backwards from the area adjacent to the first cavity (331*g*).

As illustrated in FIG. 14*b*, the at least one side locking mechanism may interact also with the rotatable retainer sleeve (250") which is provided with a longitudinally extending recess (261") for accommodating the side bar (880') of the at least one side locking mechanism.

As illustrated in FIG. 4*a*, the row of locking pins (231*a*-231*g*) in the upper part (220) of the shell comprises six or seven locking pins adapted to cooperate with bittings on an edge portion (42) of the associated key (40) being inserted into the keyway (320).

Those skilled in the art can modify, within the scope of the appended claims, the disclosed embodiments in many ways, for example by modifying the detailed structure of the key and the interchangeable cylinder lock core with its retainer sleeve mechanism, the central locking pins (with associated top pins and springs), the side locking tumblers, the optional side bar and the overall configuration of the upper and lower parts of the shell.

In certain cases, e.g. to allow for manufacturing tolerances or where it is desirable to have a row of more than four side locking tumblers in a seven pin cylinder or to have a row of more than three side locking tumblers in a six pin cylinder, the minimum length L1 of the prong holes may be just half of the length (L1+FR1) of the key plug.

What is claimed is:

1. An interchangeable cylinder lock core with a rotatable cylindrical key plug for use together with a lock unit having a housing dimensioned to receive said interchangeable cylinder lock core, there being a pair of prongs in said housing adapted to transfer a torque to said lock unit when the key plug is rotated, the interchangeable cylinder lock core comprising:

a shell having an outer contour dimensioned to fit into said housing, said shell comprising an upper part, provided with a central row of upper and lower locking pins in associated cavities, and a lower part with a cylindrical bore accommodating said rotatable key plug, at least a part of said cylindrical bore extending through a rotatable retainer sleeve, said rotatable key plug being provided with corresponding cavities for accommodating said lower locking pins in said central row, said rotatable retainer sleeve being provided with holes corresponding to said cavities for said central row of upper and lower locking pins and also being provided with an engaging member, adapted to releasably retain the interchangeable cylinder lock core in said housing, and to enable removal and replacement of the interchangeable cylinder lock core in relation to said housing of the lock unit, said key plug being formed in one piece and being rotatable in said cylindrical bore, and having a back region extending from a back end, and a front region, which adjoins said back region and extends up to a front end of the key plug and which accommodates at least one side locking mechanism being operative independently of said central row of upper and lower locking pins;

a keyway extending axially backwards from said front end axially along said key plug and being configured to accommodate an associated key with a flat key blade, said keyway being oriented in a central plane being aligned with said lower locking pins and said corresponding cavities, said lower locking pins cooperating with an edge code pattern on said flat key blade, and said side locking mechanism comprising a longitudinal row of at least two coded side locking tumblers each having a transverse finger cooperating with a wave-like side code pattern in said flat key blade, said central row of upper and lower locking pins and said at least one side locking mechanism being arranged to engage with and lock the key plug against rotation in said lower part of said shell unless said associated key with the flat key blade is inserted into said keyway, wherein:

said back region of the key plug has a minimum length of 50% of a total length of the key plug, whereas the adjoining front region of the key plug has a maximum length of 50% of said total length, said maximum length being long enough to accommodate said longitudinal row of at least two coded side locking tumblers and also the at least one independently operated side locking mechanism in its entirety, said at least one side locking mechanism thus forming a front end side locking mechanism, there being two longitudinal prong holes extending along the whole length of said back region of the key plug from said back end thereof, both of these two prong holes having substantially the same length, and each of these prong holes being dimensioned to accommodate, in use together with said lock unit, substantially a full length of a respective one of said two prongs, on each side of said keyway, said full length corresponding to but being no longer than the length of said back region of the key plug, so as to provide an effective guiding of said two prongs and a secure engagement thereof in said prong holes, when the key plug is being rotated while transferring a torque onto said two prongs, and said key plug being configured to accommodate, within said front region thereof on at least one lateral side of said keyway, said at least one front end side locking mechanism, including said longitudinal row of at least two side locking tumblers being movable up and down independently of each other, there being at least three different code positions for each coded side locking tumbler and a plurality of different code combinations for the at least two side locking tumblers in said longitudinal row in said front region of the key plug.

2. The interchangeable cylinder lock core as defined in claim 1, wherein said longitudinal row of side locking tumblers in said at least one front end side locking mechanism comprises at least three side locking tumblers.

3. The interchangeable cylinder lock core as defined in claim 1, wherein said rotatable retainer sleeve is arranged axially between a fixed front end sleeve portion and a fixed rear end sleeve portion, said fixed sleeve portions defining said cylindrical bore together with said rotatable retainer sleeve.

4. The interchangeable cylinder lock core as defined in claim 1, wherein said rotatable retainer sleeve extends from said back end of said key plug up to a fixed front end sleeve portion.

5. The interchangeable cylinder lock core as defined in claim 4, wherein said rotatable retainer sleeve has a thinner cylindrical wall than a cylindrical wall of said fixed front end sleeve portion and said fixed front end sleeve portion is integrated with a fixed rear end sleeve portion having a thinner cylindrical wall than said front end sleeve portion, said fixed rear end sleeve portion being located radially outside said rotatable retainer sleeve such that the rotatable retainer sleeve and said fixed rear end sleeve portion together have a wall thickness corresponding to the wall thickness of said fixed front end sleeve portion.

6. The interchangeable cylinder lock core as defined in claim 5, wherein said fixed front end sleeve portion as well as said rotatable retainer sleeve are provided with recesses at their inside cylindrical surfaces for accommodating at least one radially projecting part of said at least one front end side locking mechanism.

7. The interchangeable cylinder lock core as defined in claim 6, wherein said rotatable retainer sleeve has through-going holes or a longitudinal slot in a front region thereof, said through-going holes or longitudinal slot being dimensioned to receive said at least one radially projecting part of said side at least one front end locking mechanism, and said radially projecting part of the at least one front end side locking mechanism being radially longer than the thickness of the rotatable retainer sleeve in this front region so as to extend through the sleeve and engage with at least one of said recesses in the fixed front end sleeve portion.

8. The interchangeable cylinder lock core as defined in claim 1, wherein said key plug is provided with two front end side locking mechanisms, one on each side of said keyway.

9. The interchangeable cylinder lock core as defined in claim 1, wherein at least two of said coded side locking tumblers are movable between a coded releasing position where they are totally confined within the key plug, and at least one locking position where they project radially outside the key plug and engages with said at least one recess in said lower part of said shell, whereby they will prevent rotation of the key plug.

10. The interchangeable cylinder lock core as defined in claim 1, wherein said longitudinal row of coded side locking tumblers in each front end side locking mechanism cooperate with an associated side bar, forming a part of said front end side locking mechanism and being located at the cylindrical outer circumference of the key plug and being adapted to engage with an associated groove, in said lower part of said shell, so as to prevent rotation of the key plug unless said associated key is inserted into said keyway, the side bar being then seated inside the circumferential contour of the key plug.

11. The interchangeable cylinder lock core as defined in claim 10, wherein each of said coded side locking tumblers is provided with said transverse finger cooperating with a side code pattern on an associated key, and with at least one coded recess in an outside portion thereof at a distance from said transverse finger, adapted to cooperate with said side bar, so as to enable the latter to disengage from said groove in said lower part of said shell.

12. The interchangeable cylinder lock core as defined in claim 11, wherein said transverse finger is longitudinally displaced, along said keyway, to form a coded location, in relation to a central axis of the associated coded side locking tumbler, each locking tumbler being coded both in respect of the longitudinal displacement of the transverse finger, and the location of said at least one coded recess cooperating with said side bar.

13. The interchangeable cylinder lock core as defined in claim 11, wherein each of said coded side locking tumblers is movable up and down as well as rotationally in an associated cavity, the rotational position also forming a code.

14. The interchangeable cylinder lock core as defined in claim 10, wherein at least one spring is disposed between two side locking tumblers cooperating with said side bar, there being no spring located between a side locking tumbler and an end of the side bar.

15. The interchangeable cylinder lock core as defined in claim 1, wherein said rotatable retainer sleeve is positioned behind at least a first cavity disposed adjacent to the front end of the key plug.

16. The interchangeable cylinder lock core as defined in claim 15, wherein at least one of said coded side locking tumblers is positioned in front of said first cavity and will interact with a recess in the lower part of said shell.

17. A lock and key system including an interchangeable cylinder lock core as defined in claim 1, wherein the lock and key system comprises a first key for removal and replacing the interchangeable cylinder lock core in relation to said lock unit, and at least one second key for opening the cylinder lock core while retaining the cylinder lock core in the lock unit, said at least one second key comprising a grip portion and said flat key blade, wherein:

said wave-like side code pattern in said at least one second key is confined substantially to the longitudinal half of the key blade located closest to said grip portion and comprises at least two coded portions configured to interact with said at least two side locking tumblers of said at least one front end side locking mechanism, so as to position, upon being inserted into said key plug, said side locking tumblers in predetermined code locations that will open the lock by permitting rotation of said key plug within the lower part of said shell, either directly by releasing the engagement of said side locking tumblers in relation to a fixed front sleeve portion of the shell of the cylinder lock core, or via a side-bar interacting with said fixed front sleeve portion of the shell of the cylinder lock core.

18. The lock and key system as defined in claim 17, wherein at least one of said code portions of the wave-like side code pattern of said second key is located closer to the grip portion of the key than all the code portions of the edge code pattern.

19. The lock and key system as defined in claim 17, wherein the side code portions of said wave-like side code pattern are arranged in a continuous row in said longitudinal half of the key blade.

20. An interchangeable cylinder lock core with a rotatable cylindrical key plug for use together with a lock unit having a housing dimensioned to receive said interchangeable cylinder lock core, and including a torque transferring mechanism in said housing adapted to transfer a torque to said lock unit when the key plug is rotated, the interchangeable cylinder lock core comprising:

a shell having an outer contour dimensioned to fit into said housing, said shell comprising an upper part, provided with a central row of upper and lower locking pins in associated cavities, and a lower part with a cylindrical bore accommodating said rotatable key plug, at least a part of said cylindrical bore extending through a rotatable retainer sleeve, said rotatable key plug being provided with a central row of corresponding cavities cooperating with said lower locking pins, said rotatable retainer sleeve being provided with holes corresponding to said cavities for said upper and lower locking pins and also being provided with an engaging member, adapted to releasably retain the interchangeable cylinder lock core in said housing, and to enable removal and replacement of the interchangeable cylinder lock core in relation to said housing of the lock unit, said key plug being formed in one piece and being rotatable in said cylindrical bore and having a back region extending from a back end, and a front region, which adjoins said back region and extends up to a front end of the key plug, a keyway extending axially backwards from said front end axially along said key plug and being configured to accommodate an associated key with a flat key blade, said keyway being oriented in a central plane being aligned with said lower locking pins and said corresponding cavities, said lower locking pins cooperating with an edge code pattern on said flat key blade, and a side locking mechanism comprising a longitudinal row of at least two coded side locking tumblers each having a transverse finger cooperating with a wave-like side code pattern on said flat key blade, said central row of upper and lower locking pins and said side locking mechanism being arranged to engage with and lock the key plug against rotation in said lower part of said shell unless said associated key is inserted into said keyway, wherein:

said central row of upper and lower locking pins in said upper part of said shell comprises six or seven upper and lower locking pins, respectively, the lower locking pins being adapted to cooperate with bittings on an edge portion of said associated key being inserted into said keyway, said adjoining front region (FR) of the key plug accommodates, in addition to said central row of upper and lower locking pins, two side locking mechanisms, one on each lateral side of the keyway so as to engage with respective recesses in an inner circumferential surface of a fixed front end sleeve portion, which forms a portion of said lower part of said shell, each of said two side locking mechanisms is confined in its entirety in said front region of the key plug and is operative independently of said central row of upper and lower locking pins, a total length of said front region being less than half of a total length of the key plug, all of said coded side locking tumblers in each of said two side locking mechanisms are movable independently of each other, in a respective plane being parallel and displaced laterally in relation to the keyway, and said transverse finger on each of said coded side locking tumblers in each of said two side locking mechanisms cooperates with a wave like side code pattern in a respective side of said key blade, there being at least three different code positions for each coded side locking tumbler and a plurality of different code combinations for the at least two side locking tumblers in each longitudinal row in each of said two side locking mechanisms, and at least one of said coded side locking tumblers in each of said two side locking mechanisms is located in front of a first one of said corresponding cavities disposed in said central row adjacent to the front end of the key plug.

21. The interchangeable cylinder lock core as defined in claim 20, wherein said rotatable retainer sleeve is arranged between said fixed front end sleeve portion and a rear end sleeve portion, said sleeve portions defining said cylindrical bore together with said rotatable retainer sleeve.

22. The interchangeable cylinder lock core as defined in claim 20, wherein said rotatable retainer sleeve extends from said back end of said key plug up to said fixed front end sleeve portion.

23. The interchangeable cylinder lock core as defined in claim 22, wherein said rotatable retainer sleeve has a thinner cylindrical wall than said fixed front end sleeve portion and said fixed front end sleeve portion is integrated with a rear end sleeve portion having a thinner cylindrical wall than said front end sleeve portion, said rear end sleeve portion being located radially outside said rotatable retainer sleeve such that the retainer sleeve and said front end sleeve portion define said cylindrical bore.

24. The interchangeable cylinder lock core as defined in claim 22, wherein said fixed front end sleeve portion as well as said rotatable retainer sleeve portion are provided with recesses at their inside cylindrical surfaces for accommodating radially projecting parts of each side locking mechanism.

25. The interchangeable cylinder lock core as defined in claim 20, wherein at least two of said coded side locking tumblers are movable between a coded releasing position where they are totally confined within the key plug, and at least one locking position where they project radially outside the key plug and engage with the inside of said fixed front end sleeve portion, whereby it will prevent rotation of the key plug.

26. The interchangeable cylinder lock core as defined in claim 20, wherein said coded side locking tumblers in each side locking mechanism cooperate with an associated side bar located at the cylindrical outer circumference of the key plug and being adapted to engage with an associated groove at the inside of said fixed front end sleeve portion, so as to prevent rotation of the key plug unless a correctly cut key is inserted into said keyway, the side bar being then seated inside the circumferential contour of the key plug.

27. The interchangeable cylinder lock core as defined in claim 26, wherein each of said coded side locking tumblers is provided with said transverse finger cooperating with a side code pattern on an associated key, and with at least one recess in an outside portion thereof at a distance from said transverse finger, adapted to cooperate with said side bar, so as to enable the latter to disengage from said groove at the inside of said front end sleeve portion.

28. The interchangeable cylinder lock core as defined in claim 27, wherein said transverse finger is longitudinally displaced, along said keyway, to form a coded location, in relation to a central axis of the associated coded side locking tumbler, each locking tumbler being coded both in respect of the longitudinal displacement of the transverse finger, and the location of said at least one recess cooperating with said side bar.

29. The interchangeable cylinder lock core as defined in claim 27, wherein each of said coded side locking tumblers is movable up and down or elevationally as well as rotationally in an associated cavity, the rotational position also forming a code.

30. The interchangeable cylinder lock core as defined in claim 20, wherein each of said two side locking mechanisms extends backwards from the area adjacent to the first cavity in said central row.

31. The interchangeable cylinder lock core as defined in claim 30, wherein each side locking mechanism interacts also with said rotatable retainer sleeve which is provided with a longitudinally extending recess for accommodating a radially projecting part of each side locking mechanism.

32. The interchangeable cylinder lock core as defined in claim 20, wherein said rotatable retainer sleeve has a holding lug adapted to engage, upon insertion of the interchangeable cylinder lock core into the lock unit, with a recess having a shoulder at the inside of said housing of said lock unit, said holding lug on the rotatable retainer sleeve having a stop end surface being located longitudinally at the front end of said rotatable retainer sleeve.

33. An interchangeable cylinder lock core with a rotatable cylindrical key plug for use together with a lock unit having a housing dimensioned to receive said interchangeable cylinder lock core, and including a torque transferring mechanism in said housing adapted to transfer a torque to said lock unit when the key plug is rotated, the interchangeable cylinder lock core comprising:

a shell having an outer contour dimensioned to fit into said housing, said shell comprising an upper part, provided with a central row of upper and lower locking pins in associated cavities and a lower part with a cylindrical bore accommodating said rotatable key plug, at least a part of said cylindrical bore extending through a rotatable retainer sleeve, said rotatable key plug being provided with corresponding cavities for accommodating said lower locking pins in said central row, said rotatable retainer sleeve being provided with holes corresponding to said cavities for said central row of upper and lower locking pins and also being provided with an engaging member, adapted to releasably retain the interchangeable cylinder lock core in said housing, and to enable removal and replacement of the interchangeable cylinder lock core in relation to said housing of the lock unit, said key plug being formed in one piece and being rotatable in said cylindrical bore and having a back region extending from a back end, and a front region, which adjoins said back region and extends up to a front end of the key plug and which accommodates at least one side locking mechanism being operative independently of said central row of upper and lower locking pins, a keyway extending axially backwards from said front end axially along said key plug and being configured to accommodate an associated key with a flat key blade, said central row of upper and lower locking pins and said at least one side locking mechanism being arranged to engage with and lock the key plug against rotation in said lower part of said shell unless said associated key is inserted into said keyway, said at least one side locking mechanism engaging with an inner circumferential surface of a fixed sleeve portion, which forms a portion of said lower part of said shell, said at least one side locking mechanism comprising a longitudinal row of at least two coded side locking tumblers which are each movable independently of each other, there being at least three different code positions for each coded side locking tumbler and a plurality of different code combinations for the at least two side locking tumblers in said longitudinal row, said longitudinal row of at least two coded side locking tumblers cooperating with an associated side bar, forming a part of said side locking mechanism and being adapted to engage with an associated groove at the inside of said fixed sleeve portion forming a part of said lower part of said shell, wherein:

said central row of upper and lower locking pins in said upper part of said shell comprises six or seven upper and lower locking pins, respectively, adapted to cooperate with bittings on an edge portion of said associated key blade being inserted into said keyway, said side locking mechanism, including said longitudinal row of side locking tumblers and said sidebar, is confined in its entirety to said front region of said key plug, and a single spring is disposed between the two neighboring side locking tumblers being located closest to said front end of the key plug and cooperating with said side bar and, if there are more than two side locking tumblers in said longitudinal row, also the single spring between the two neighboring side locking tumblers being located closest to said back end of the side bar, there being no spring located between a side locking tumbler and an end of the side bar, whereby a total longitudinal length of said front region of the key plug, accommodating said side locking mechanism including a sidebar, is minimized, said total longitudinal length of said front region being less than half of the total length of the key plug.

34. The interchangeable cylinder lock core as defined in claim 33, wherein said rotatable retainer sleeve is arranged between a fixed front end sleeve portion and a rear end sleeve portion, said sleeve portions defining said cylindrical bore together with said rotatable retainer sleeve.

35. The interchangeable cylinder lock core as defined in claim 33, wherein said rotatable retainer sleeve extends from said back end of said key plug up to a fixed front end sleeve portion.

36. The interchangeable cylinder lock core as defined in claim 35, wherein said rotatable retainer sleeve has a thinner cylindrical wall than said fixed front end sleeve portion and said fixed front end sleeve portion is integrated with a rear end sleeve portion having a thinner cylindrical wall than said front end sleeve portion, said rear end sleeve portion being located radially outside said rotatable retainer sleeve such that the retainer sleeve and said front end sleeve portion define said cylindrical bore.

37. The interchangeable cylinder lock core as defined in claim 36, wherein said fixed front end sleeve portion as well as said rotatable retainer sleeve portion are provided with recesses at their inside cylindrical surfaces for accommodating said side bar of said at least one side locking mechanism.

38. The interchangeable cylinder lock core as defined in claim 33, wherein each of said coded side locking tumblers in said front region of the key plug is provided with a transverse finger being held in direct contact with a side code pattern on said associated key blade.

39. The interchangeable cylinder lock core as defined in claim 33, wherein each of said coded side locking tumblers is provided with a transverse finger cooperating with a side code pattern in said key blade, and with at least one recess in an outside portion thereof at a distance from said transverse finger, adapted to cooperate with said side bar, so as to enable the latter to disengage from said groove at the inside of said sleeve portion.

40. The interchangeable cylinder lock core as defined in claim 39, wherein said transverse finger is longitudinally displaced, along said keyway, to form a coded location, in relation to a central axis of the associated coded side locking tumbler, each locking tumbler being coded both in respect of the longitudinal displacement of the transverse finger, and the location of said at least one recess cooperating with said side bar.

41. The interchangeable cylinder lock core as defined in claim 33, wherein each of said coded side locking tumblers is movable up and down or elevationally as well as rotationally in an associated cavity, the rotational position also forming a code.

42. The interchangeable cylinder lock core as defined in claim 33, wherein the key plug is provided with two side locking mechanisms each having a side bar, one on each side of said keyway.

43. The interchangeable cylinder lock core as defined in claim 33, wherein said at least one coded side locking mechanism extends backwards from the area adjacent to said two neighboring side locking tumblers being located closest to said front end of the key plug.

44. The interchangeable cylinder lock core as defined in claim 33, wherein said at least one side locking mechanism interacts also with said rotatable retainer sleeve which is provided with a longitudinally extending recess for accommodating said side bar of said at least one side locking mechanism.

45. The interchangeable cylinder lock core as defined in claim 33, wherein said rotatable retainer sleeve has a holding lug adapted to engage, upon insertion of the interchangeable cylinder lock core into the lock unit, with a recess having a shoulder at the inside of said housing of said lock unit, said holding lug on the rotatable retainer sleeve having a stop end surface being located longitudinally at the front end of said rotatable retainer sleeve.

46. An interchangeable cylinder lock core with a rotatable cylindrical key plug for use together with a lock unit having a housing dimensioned to receive said interchangeable cylinder lock core, there being a pair of longitudinally extending prongs in said housing adapted to transfer a torque to said lock unit when the key plug is rotated, the interchangeable cylinder lock core comprising:

a shell having an outer contour dimensioned to fit into said housing, said shell comprising an upper part, provided with a central row of upper and lower locking pins in associated cavities, and a lower part with a cylindrical bore accommodating said rotatable key plug, at least a part of said cylindrical bore extending through a rotatable retainer sleeve, said rotatable key plug being provided with a central row of corresponding cavities cooperating with said central row of locking pins, said rotatable retainer sleeve being provided with holes corresponding to said cavities for said central row of upper and lower locking pins and also being provided with an engaging member, adapted to releasably retain the interchangeable cylinder lock core in said housing, and to enable removal and replacement of the interchangeable cylinder lock core in relation to said housing of the lock unit, said key plug being rotatable in said cylindrical bore and having a back region extending from a back end, and a front region, which adjoins said back region and extends up to a front end of the key plug;

a keyway extending axially backwards from said front end axially along said key plug and being configured to accommodate an associated key with a flat key blade, said keyway being oriented in a central plane being aligned with said lower locking pins and said corresponding cavities, said lower locking pins cooperating with an edge code pattern on said flat key blade, and a side locking mechanism comprising a longitudinal row of at least two coded side locking tumblers each having a transverse finger cooperating with a wave-like side code pattern on said flat key blade, said central row of upper and lower locking pins being arranged to engage with and lock the key plug against rotation in said lower part of said shell unless said associated key is inserted into said keyway, wherein:

there being two longitudinally extending prong holes extending along the whole length of said back region of the key plug from said back end thereof so as to provide, in use together with said lock unit, an effective guiding of said two longitudinally extending prongs and a secure engagement of the two longitudinally extending prongs in said two longitudinally extending prong holes, when the key plug is being rotated while transferring a torque onto said two longitudinally extending prongs, said two longitudinally extending prong holes are entirely confined within said back region of the key plug, said back region of the key plug, accommodating said two longitudinally extending prong holes, has a minimum length of at least half of the length of the key plug, the adjoining front region of the key plug, located in front of said two longitudinally extending prong holes, thus having a length being no longer than half of the length of the key plug, said adjoining front region of the key plug accommodates, in addition to said central row of upper and lower locking pins, two side locking mechanisms, one on each lateral side of said keyway and each comprising a longitudinal row of at least two coded side locking tumblers, and each being located in its entirety within said front region of the key plug and being adapted to interact with at least one associated recess in a fixed front end sleeve portion, said fixed front end sleeve portion, forming a portion of said lower part of said shell, is located radially outside said front region of the key plug and is provided with at least two recesses for receiving and engaging with at least one radially projecting part of each of said two side locking mechanisms, said two side locking mechanisms are operative independently of said central row of upper and lower locking pins, and are disposed on each lateral side of said keyway, and all coded side locking tumblers in each of said two side locking mechanisms are movable in a respective plane being parallel and displaced laterally in relation to the keyway, there being at least three different code positions for each coded side locking tumbler and a plurality of different code combinations for all the coded side locking tumblers in said two side locking mechanisms in said front region of the key plug, and at least one coded side locking tumbler in each of said two side locking mechanisms is located in front of a first one of said corresponding cavities disposed in said central row adjacent to the front end of the key plug.

47. A key for opening an associated interchangeable cylinder lock core with a rotatable cylindrical key plug having a side locking mechanism, including at least two side locking tumblers, being confined to a front region of the key plug, the key comprising a grip part and a flat key blade with two sides, wherein:

said flat key blade has, on at least one of said two sides, a longitudinal profile groove, said longitudinal profile groove has two opposite, upper and lower surfaces, one of said opposite surfaces has two longitudinally adjoining portions configured to cooperate with said two side locking tumblers of said associated interchangeable lock core, namely a first portion confined to a longitudinal half of the key blade being located closest to said grip part and a second portion adjoining to said first portion and extending to a free end of the key blade, said first portion of one of said opposite surfaces of said longitudinal groove forming a wave-like side code wave pattern with at least two side code wave portions defining a wave-like curve with wave-flanks rising and falling in a plane being parallel to the respective side of said key blade, and said adjoining second portion of said one of said opposite surfaces of said longitudinal groove being straight.

* * * * *